US011482157B2

(12) United States Patent
Lim et al.

(10) Patent No.: US 11,482,157 B2
(45) Date of Patent: Oct. 25, 2022

(54) DISPLAY DEVICE AND DRIVING METHOD THEREOF

(71) Applicant: Samsung Display Co., Ltd., Yongin-Si (KR)

(72) Inventors: Jae Keun Lim, Yongin-si (KR); Hong Soo Kim, Yongin-si (KR); Jin Young Roh, Yongin-si (KR); Se Hyuk Park, Yongin-si (KR); Hyo Jin Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/535,331

(22) Filed: Nov. 24, 2021

(65) Prior Publication Data

US 2022/0262296 A1 Aug. 18, 2022

(30) Foreign Application Priority Data

Feb. 15, 2021 (KR) ..... 10-2021-0020156

(51) Int. Cl.
*G09G 3/20* (2006.01)

(52) U.S. Cl.
CPC ... *G09G 3/2092* (2013.01); *G09G 2310/0267* (2013.01); *G09G 2310/0286* (2013.01); *G09G 2310/08* (2013.01); *G09G 2320/0247* (2013.01); *G09G 2320/103* (2013.01); *G09G 2330/021* (2013.01); *G09G 2340/0435* (2013.01); *G09G 2360/16* (2013.01)

(58) Field of Classification Search
CPC ..... G09G 3/2092; G09G 2310/0267; G09G 2320/0247; G09G 2330/021; G09G 2340/0435; G09G 2360/16
See application file for complete search history.

(56) References Cited

U.S. PATENT DOCUMENTS 8,044,948 B2 * 10/2011 Lee ..... G09G 3/3648 345/204
9,165,524 B2 * 10/2015 Sohn ..... G09G 3/3696
2012/0169789 A1 * 7/2012 Origuchi ..... G09G 3/2965 345/63
2022/0020311 A1 1/2022 Lim et al.

FOREIGN PATENT DOCUMENTS

KR 10-2022-0011262 A 1/2022

* cited by examiner

*Primary Examiner* — Gene W Lee
(74) *Attorney, Agent, or Firm* — Innovation Counsel LLP

(57) ABSTRACT

Provided is a display device including a pixel unit in which each of pixel rows extends in a first direction, odd numbered pixel rows and even numbered pixel rows are alternately disposed in a second direction, and pixels included in the pixel rows are designated as dots having two or more units, a gray difference calculator that calculates difference between representative grays of dots adjacent in the second direction among dots of a p-th pair of the pixel rows, an edge detector that increases an edge dot number when a first condition in which the difference between the representative grays is larger than a first threshold value is satisfied, and a first pattern detector that increases an edge number when the edge dot number is larger than a second threshold value, and that generates a first pattern detection signal when the edge number is larger than a third threshold value.

20 Claims, 21 Drawing Sheets

DISPLAY DEVICE AND DRIVING METHOD THEREOF

CROSS-REFERENCE TO RELATED APPLICATION

This application claims priority to and the benefit of Korean Patent Application No. 10-2021-0020156 filed in the Korean Intellectual Property Office on Feb. 15, 2021, the entire contents of which are incorporated herein by reference.

BACKGROUND

1. Field

The present disclosure generally relates to a display device and a driving method of the same. More particularly, the present disclosure relates to a display device that enables to prevent a flicker and a driving method of the same.

2. Description of the Related Art

As information technology has developed, importance of a display device, which is a connection medium between a user and information, has been highlighted. Accordingly, the use of display devices such as a liquid crystal display device, an organic light emitting display device, and the like has been increasing.

When the display device displays a moving picture, it is preferable to display it at a high frequency because its motion may be smoothly displayed. However, when the display device displays a still image, since there is no motion, it is fine even to display the still image at a low frequency. In addition, when the still image is displayed at a low frequency, it is advantageous in terms of power consumption.

However, when a display frequency of the display device is switched from a high frequency to a low frequency, there is a problem that a flicker may be viewed as a luminance reduction period is changed. In addition, a flicker may occur when a specific pattern is displayed during low-frequency driving.

SUMMARY

The present disclosure has been made in an effort to provide a display device and a driving method thereof that may prevent a flicker from being viewed when a display frequency is switched from a high frequency to a low frequency.

In addition, the present disclosure has been made in an effort to provide a display device and a driving method thereof that may prevent a flicker from occurring when a specific pattern is displayed during low-frequency driving.

An embodiment of the present disclosure provides a display device including: a pixel unit in which respective pixel rows extend in a first direction, odd numbered pixel rows and even numbered pixel rows are alternately disposed in a second direction, and pixels included in the respective pixel rows are designated as dots in two or more units; a gray difference calculator that calculates a difference between representative grays of dots adjacent in the second direction among dots of a p-th pair of the pixel rows; an edge detector that increases an edge dot number when a first condition in which the difference between the representative grays is larger than a first threshold value is satisfied; and a first pattern detector that increases an edge number when the edge dot number is larger than a second threshold value, and that generates a first pattern detection signal when the edge number is larger than a third threshold value.

The display device may further include a scan driver that, when the first pattern detection signal is not generated and when an image is determined to be a still image, provides scan signals having a turn-on level to the odd-numbered pixel rows during a first sub-frame period, and provides scan signals having a turn-on level to the even-numbered pixel rows during a second sub-frame period after the first sub-frame period.

When the first pattern detection signal is generated and when the image is determined to be the still image, the scan driver may alternately provide the scan signals having the turn-on level to the odd numbered pixel rows and the even numbered pixel rows.

The gray difference calculator may calculate a difference between the representative grays of a predetermined number of dots including q-th dots in the first direction among the dots of the p-th pair, and may increase q.

When a second condition that the edge number is 0 or a (p−1)-th pair is an edge is satisfied in addition to the first condition, the edge detector may increase the edge dot number and registers the p-th pair as the edge.

When at least one of the first condition and the second condition is not satisfied, the edge detector may register the p-th pair as a non-edge, and may initialize the edge dot number.

After the p-th pair is registered as the edge or the non-edge, when increased q-th dots are not last dots of the p-th pair, the gray difference calculator may calculate a difference between representative grays of a predetermined number of dots including the increased q-th dots.

The first pattern detector may operate only when the increased q-th dots are the last dots of the p-th pair after the p-th pair is registered as the edge or the non-edge.

When the edge dot number is smaller than the second threshold value, the first pattern detector may initialize the edge number.

When the edge dot number is smaller the second threshold value or the edge number is smaller than the third threshold value, the gray difference calculator may calculate a difference between representative grays of dots adjacent to the second direction among dots of a (p+1)-th pair of the pixel rows.

The first pattern detector, when the first pattern detection signal is generated, may further generate pattern position information for a detected pattern, and the display device may further include a pattern luminance calculator that calculates luminance of the pattern based on the pattern position information and the representative grays.

The pattern luminance calculator may generate a pattern valid signal when the luminance of the pattern is larger than a reference luminance, and the display device may further include a second pattern detector that generates a second pattern detection signal only when both the pattern valid signal and the first pattern detection signal are received.

The display device may further include a scan driver that, when the second pattern detection signal is not generated and when an image is determined to be a still image, provides scan signals having a turn-on level to the odd-numbered pixel rows during the first sub-frame period, and provides scan signals having a turn-on level to the even-numbered pixel rows during the second sub-frame period after the first sub-frame period.

When the second pattern detection signal is generated and when the image is determined to be the still image, the scan driver may alternately provide the scan signals having the turn-on level to the odd numbered pixel rows and the even numbered pixel rows.

Another embodiment of the present disclosure provides a driving method of a display device that includes a pixel unit in which respective pixel rows extend in a first direction, odd numbered pixel rows and even numbered pixel rows are alternately disposed in a second direction, and pixels included in the respective pixel rows are designated as dots in two or more units, including: calculating a difference between representative grays of dots adjacent in the second direction among dots of a p-th pair of the pixel rows; increasing an edge dot number when a first condition that the difference between the representative grays is larger than the first threshold value is satisfied; increasing an edge number when the edge dot number is larger than a second threshold value; and generating a first pattern detection signal when the edge number is larger than a third threshold value.

The driving method may further include: providing, when the first pattern detection signal is not generated and when an image is determined to be a still image, scan signals having a turn-on level to the odd-numbered pixel rows during a first sub-frame period, and providing scan signals having a turn-on level to the even-numbered pixel rows during a second sub-frame period after the first sub-frame period.

The driving method may further include: alternately providing, when the first pattern detection signal is generated and when the image is determined to be the still image, the scan signals having the turn-on level to the odd numbered pixel rows and the even numbered pixel rows.

The driving method may further include: generating, when the first pattern detection signal is generated, pattern position information for a detected pattern; calculating luminance of the pattern based on the pattern position information and the representative grays; generating a pattern valid signal when the luminance of the pattern is larger than a reference luminance; and generating a second pattern detection signal only when both the pattern valid signal and the first pattern detection signal are received.

The driving method may further include: providing, when the second pattern detection signal is not generated and when an image is determined to be a still image, scan signals having a turn-on level to the odd-numbered pixel rows during the first sub-frame period, and providing scan signals having a turn-on level to the even-numbered pixel rows during the second sub-frame period after the first sub-frame period.

The driving method may further include: alternately providing, when the second pattern detection signal is generated and when the image is determined to be the still image, the scan signals having the turn-on level to the odd numbered pixel rows and the even numbered pixel rows.

The display device and the driving method thereof according to the present disclosure may prevent a flicker from being viewed when a display frequency is switched from a high frequency to a low frequency.

The display device and the driving method thereof according to the present disclosure may prevent a flicker from occurring when a specific pattern is displayed during low-frequency driving.

DETAILED DESCRIPTION OF THE EMBODIMENTS

Figure 1:
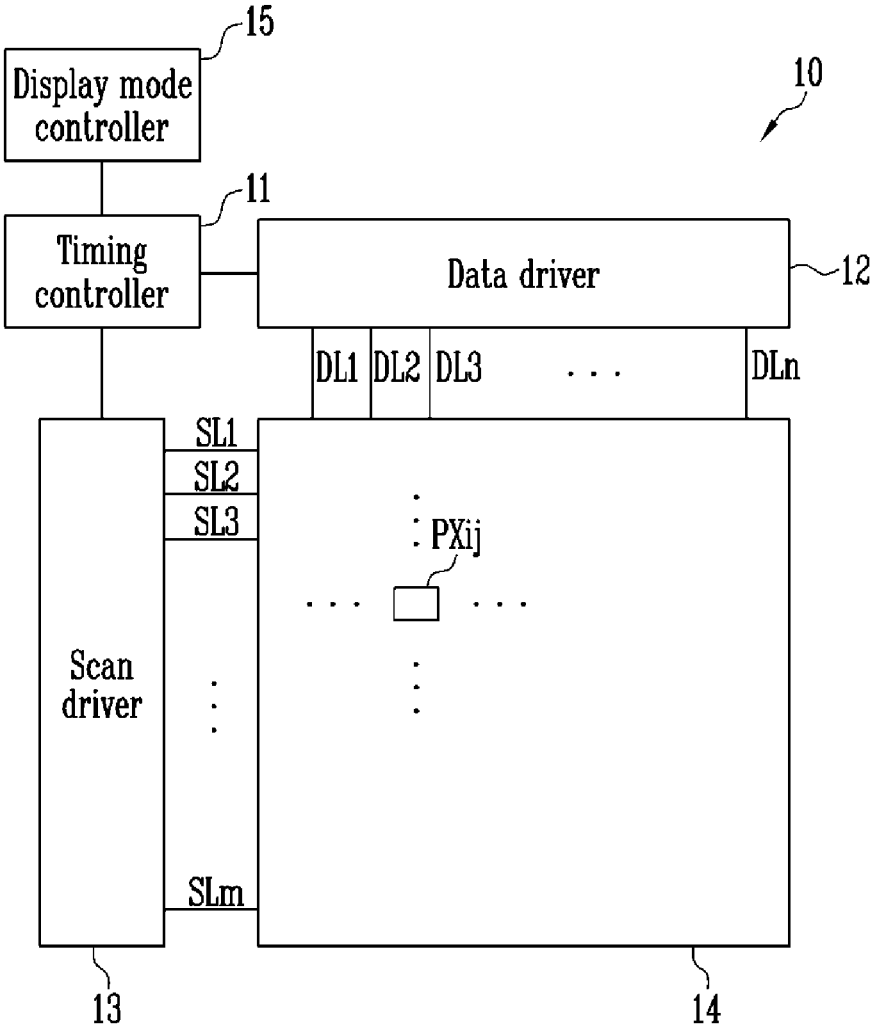
FIG. 1 illustrates a schematic view for explaining a display device according to an embodiment of the present disclosure.

The present disclosure will be described more fully hereinafter with reference to the accompanying drawings, in which embodiments of the disclosure are shown. As those skilled in the art would realize, the described embodiment may be modified in various different ways, all without departing from the spirit or scope of the present.

In order to clearly describe the present disclosure, parts that are irrelevant to the description are omitted, and identical or similar constituent elements throughout the specification are denoted by the same reference numerals. Therefore, the above-mentioned reference numerals may be used in other drawings.

Further, in the drawings, the size and thickness of each element are arbitrarily illustrated for ease of description, and the present disclosure is not necessarily limited to those illustrated in the drawings. In the drawings, the thicknesses of layers, films, panels, regions, etc. may be exaggerated for clarity.

In addition, the expression "equal to or the same as" in the description may mean "substantially equal to or the same as". That is, it may be the same enough to convince those skilled in the art to be the same. Even other expressions may be expressions from which "substantially" is omitted.

FIG. 1 illustrates a schematic view for explaining a display device according to an embodiment of the present disclosure.

Referring to FIG. 1, a display device 10 according to an embodiment of the present disclosure may include a timing controller 11, a data driver 12, a scan driver 13, a pixel unit 14, and a display mode controller 15.

The timing controller 11 may receive an external input signal from an external processor. The external input signal may include a vertical synchronization signal, a horizontal synchronization signal, a data enable signal, RGB data, and the like. The vertical synchronization signal may include a plurality of pulses, and may indicate that a previous frame period ends and a current frame period begins based on a time point at which each pulse is generated. An interval between adjacent pulses of the vertical synchronization signal may correspond to one frame period. The horizontal synchronization signal may include a plurality of pulses, and may indicate that a previous horizontal period ends and a new horizontal period begins based on a time point at which each pulse is generated. An interval between adjacent pulses of the horizontal synchronization signal may correspond to one horizontal period. The data enable signal may indicate that the RGB data is supplied in the horizontal period. The RGB data may be supplied in units of pixel rows in the horizontal periods in response to the data enable signal. The RGB data corresponding to one frame may be referred to as one input image.

The display mode controller 15 may determine a first display mode or a second display mode based on an input image. The timing controller 11 may control scan signals of the scan driver 13, depending on the determined display mode. For example, the timing controller 11 may control supply timing of scan signals of a turn-on level of the scan driver 13, depending on the determined display mode. In some embodiments, the timing controller 11 may control grays to be supplied to the data driver 12 depending on the determined display mode.

The display mode controller 15 may be configured as an independent integrated chip (IC) or hardware that is separate from the timing controller 11. In another embodiment, the display mode controller 15 may be configured as the same IC or hardware integrated with the timing controller 11. In another embodiment, the display mode controller 15 may be configured as software of the timing controller 11.

The data driver 12 may provide data voltages corresponding to grays of the input images to the pixels. For example, the data driver 12 may sample grays by using a clock signal and apply data voltages corresponding to the grays to the data output lines DL1 to DLn in units of scan lines, wherein "n" may be an integer larger than zero.

The scan driver 13 may receive a clock signal, a scan start signal, and the like from the timing controller 11 to generate scan signals to be provided to scan lines (SL1, SL2, SL3, . . . , SLm), wherein "m" may be an integer larger than zero.

The pixel unit 14 includes dots. Each dot may include at least two pixels of different colors. The dot may be a display unit for displaying a combined color. For example, an external processor may provide grays in dot units. Each pixel PXij may be connected to a corresponding data line and scan line, wherein i and j may be integers larger than zero. For example, a pixel PXij may mean a pixel in which a scan transistor is connected to an i-th scan line and a j-th data line.

Although not shown, the display device 10 may further include an emission driver. The emission driver may receive a clock signal, an emission stop signal, and the like from the timing controller 11 to generate emission signals to provide to emission lines. For example, the emission driver may include emission stages connected to the emission lines. The emission stages may be configured in a form of a shift register. For example, a first emission stage may generate an emission signal of a turn-off level based on the emission stop signal of a turn-off level, and the remaining emission stages may sequentially generate emission signals of a turn-off level based on an emission signal of a turn-off level of a previous emission stage.

When the display device 10 includes the above-described emission driver, each pixel PXij further includes a transistor connected to the emission line. This transistor may be turned off during a data writing period of each pixel PXij to prevent light emitting of the pixel PXij. Hereinafter, it will be assumed and described that the emission driver is not provided.

Figure 2:
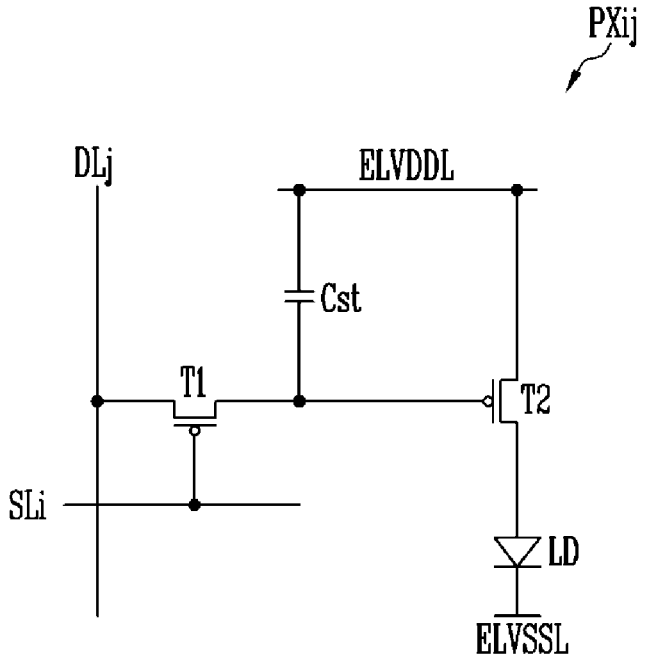
FIG. 2 illustrates a schematic view for explaining a pixel according to an embodiment of the present disclosure.

FIG. 2 illustrates a schematic view for explaining a pixel according to an embodiment of the present disclosure.

A gate electrode of a first transistor T1 may be connected to an i-th scan line SLi, a first electrode thereof may be connected to a j-th data line DLj, and a second electrode thereof may be connected to a second electrode of a storage capacitor Cst. The first transistor T1 may be referred to as a scan transistor.

A gate electrode of a second transistor T2 may be connected to the second electrode of the first transistor T1, a first electrode thereof may be connected to a first power line ELVDDL, and a second electrode thereof may be connected to the anode of a light emitting diode LD. The second transistor T2 may be referred to as a driving transistor.

A first electrode of the storage capacitor Cst may be connected to the first power line ELVDDL, and the second electrode thereof may be connected to the gate electrode of the second transistor T2 and the second electrode of the first transistor T1 simultaneously.

The anode of the light emitting diode LD may be connected to the second electrode of the second transistor T2, and a cathode thereof may be connected to a second power line ELVSSL. During a light emitting period of the light emitting diode LD, a first power voltage applied to the first power line ELVDDL may be greater than a second power voltage applied to the second power line ELVSSL.

Here, the transistors T1 and T2 are illustrated as P-type transistors, but those skilled in the art may replace at least one of the transistors with an N-type transistor by inverting a phase of a signal.

When a scan signal having a turn-on level (here, a logic low level) is applied through the scan line SLi, the first transistor T1 is turned on. In this case, a data voltage applied to the data line DLj is stored in the storage capacitor Cst.

A driving current, which corresponds to a voltage difference between the first electrode and the second electrode of the storage capacitor Cst, flows between the first electrode and the second electrode of the second transistor T2. Thus, the light emitting diode LD emits light with luminance corresponding to the data voltage.

Next, when a scan signal of a turn-off level (here, a logic high level) is applied through the scan line SLi, the first transistor T1 is turned off, and the data line DLj and the second electrode of the storage capacitor Cst are electrically separated. Therefore, even if the data voltage of the data line DLj is changed, the voltage stored in the second electrode of the storage capacitor Cst is not changed.

The embodiments of the present disclosure may be applied not only to the pixel PXij of FIG. 2, but also to a pixel having another pixel circuit according to the conventional art.

Figure 3:
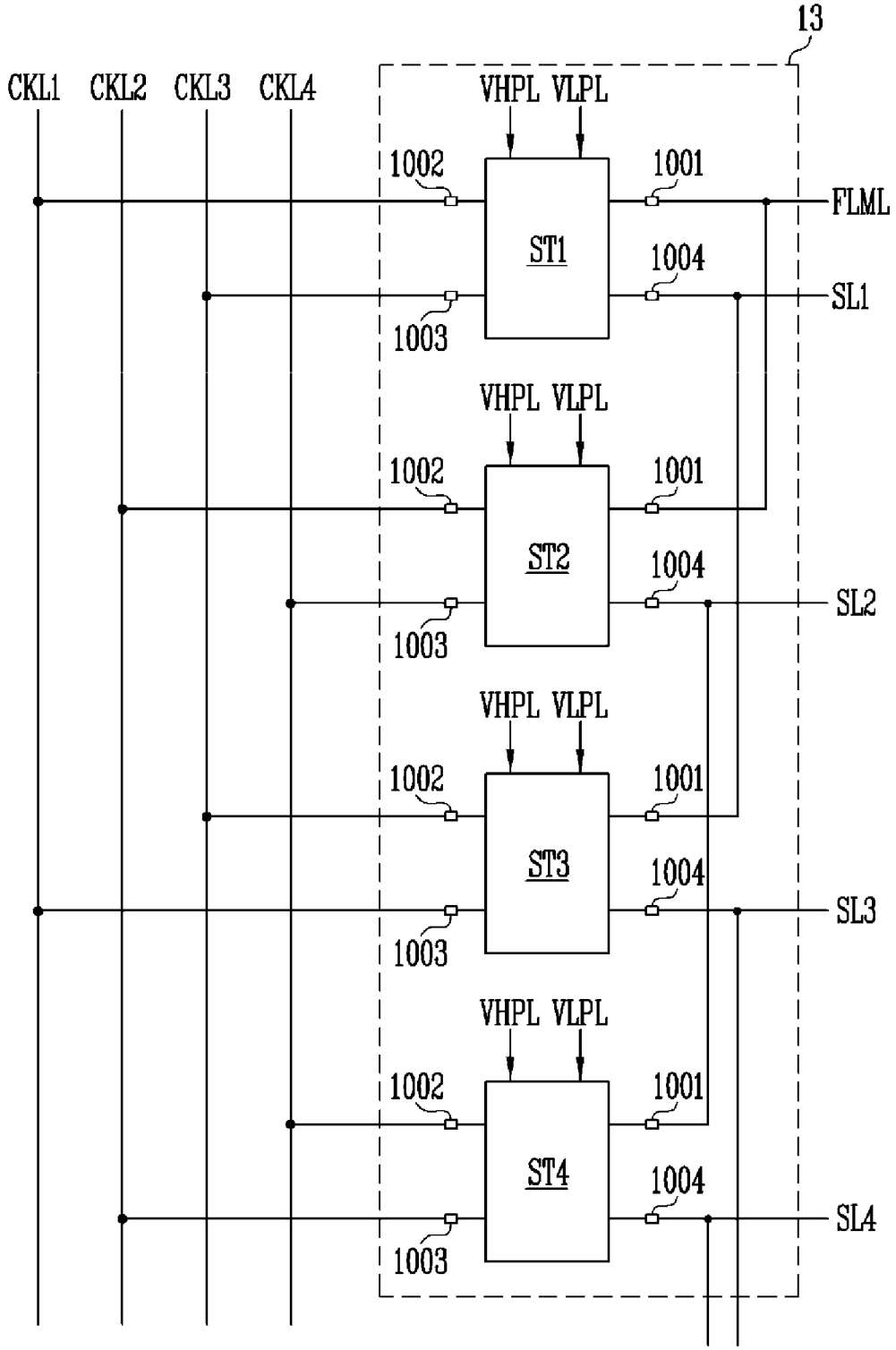
FIG. 3 illustrates a schematic view for explaining a scan driver according to an embodiment of the present disclosure.

FIG. 3 illustrates a schematic view for explaining a scan driver according to an embodiment of the present disclosure.

The scan driver 13 may include first stages (ST1, ST3, . . . ) connected to the first scan lines (SL1, SL3, . . . ) and second stages (ST2, ST4, . . . ) connected to the second scan lines (SL2, SL4, . . . ).

The first scan lines (SL1, SL3, . . . ) may be connected to the first dots. For example, the first scan lines (SL1, SL3, . . . ) may be odd-numbered scan lines. For example, the first stages (ST1, ST3, . . . ) may be odd-numbered stages.

The second scan lines (SL2, SL4, . . . ) may be connected to the second dots. For example, the second scan lines (SL2, SL4, . . . ) may be even-numbered scan lines. For example, the second stages (ST2, ST4, . . . ) may be even-numbered stages.

Each of the stages ST1, ST2, ST3, and ST4 may include a first input terminal 1001, a second input terminal 1002, a third input terminal 1003, and an output terminal 1004. The first start stage ST1 of the first stages (ST1, ST3, . . . ) and the second start stage ST2 of the second stages (ST2, ST4, . . . ) may be connected to the same scan start line FLML. For example, the first input terminal 1001 of the first start stage ST1 and the first input terminal 1001 of the second start stage ST2 may be connected to the same scan start line FLML. The output terminal 1004 of the first start stage ST1 may be connected to the first scan line SL1, and the output terminal 1004 of the second start stage ST2 may be connected to the second scan line SL2.

Each of the first stages (ST3, . . . ) excluding the first start stage ST1 may be connected to the first scan line of the previous first stage. Each of the second stages (ST4, . . . ) excluding the second start stage ST2 may be connected to the second scan line of the previous second stage. For example, the first input terminal 1001 of the first stage ST3 may be connected to the first scan line SL1 of the first start stage ST1. In addition, the first input terminal 1001 of the second stage ST4 may be connected to the second scan line SL2 of the second start stage ST2.

The first stages (ST1, ST3, . . . ) may be connected to first clock lines CKL1 and CKL3. The first clock lines CKL1 and CKL3 may be alternately connected to the second input terminal 1002 and the third input terminal 1003 of the first stages (ST1, ST3, . . . ). That is, the second input terminal 1002 of the first start stage ST1 is connected to CKL1, and the third input terminal 1003 of the first start stage ST1 is connected to CKL3. On the contrary, the second input terminal 1002 of the third start stage ST3 is connected to CKL3, and the third input terminal 1003 of the third start stage ST3 is connected to CKL1. The second stages (ST2, ST4, . . . ) may be connected to second clock lines CKL2 and CKL4 different from the first clock lines CKL1 and CKL3. The second clock lines CKL2 and CKL4 may be alternately connected to the second input terminal 1002 and the third input terminal 1003 of the second stages (ST2, ST4, . . . ). That is, the second input terminal 1002 of the second start stage ST2 is connected to CKL2, and the third input terminal 1003 of the second start stage ST2 is connected to CKL4. On the contrary, the second input terminal 1002 of the fourth start stage ST4 is connected to CKL4, and the third input terminal 1003 of the fourth start stage ST4 is connected to CKL2.

Each of the stages ST1, ST2, ST3, and ST4 may be connected to a power line VHPL and a power line VLPL. Here, a voltage of the power line VHPL may be set to a turn-off level (gate-off voltage, logic high level). In addition, a voltage of the power line VLPL may be set to a turn-on level (gate-on voltage, logic low level).

In the embodiment of FIG. 3, the first start stage ST1 and the second start stage ST2 are connected to the same scan start line FLML, but in some embodiments, the first start stage ST1 and the second start stage ST2 may also be connected to different scan start lines from each other. Even when the first start stage ST1 and the second start stage ST2 are connected to different scan start lines, a driving method thereof may be the same as that of the embodiment of FIG. 3, so that a redundant description will be omitted below.

Figure 4:
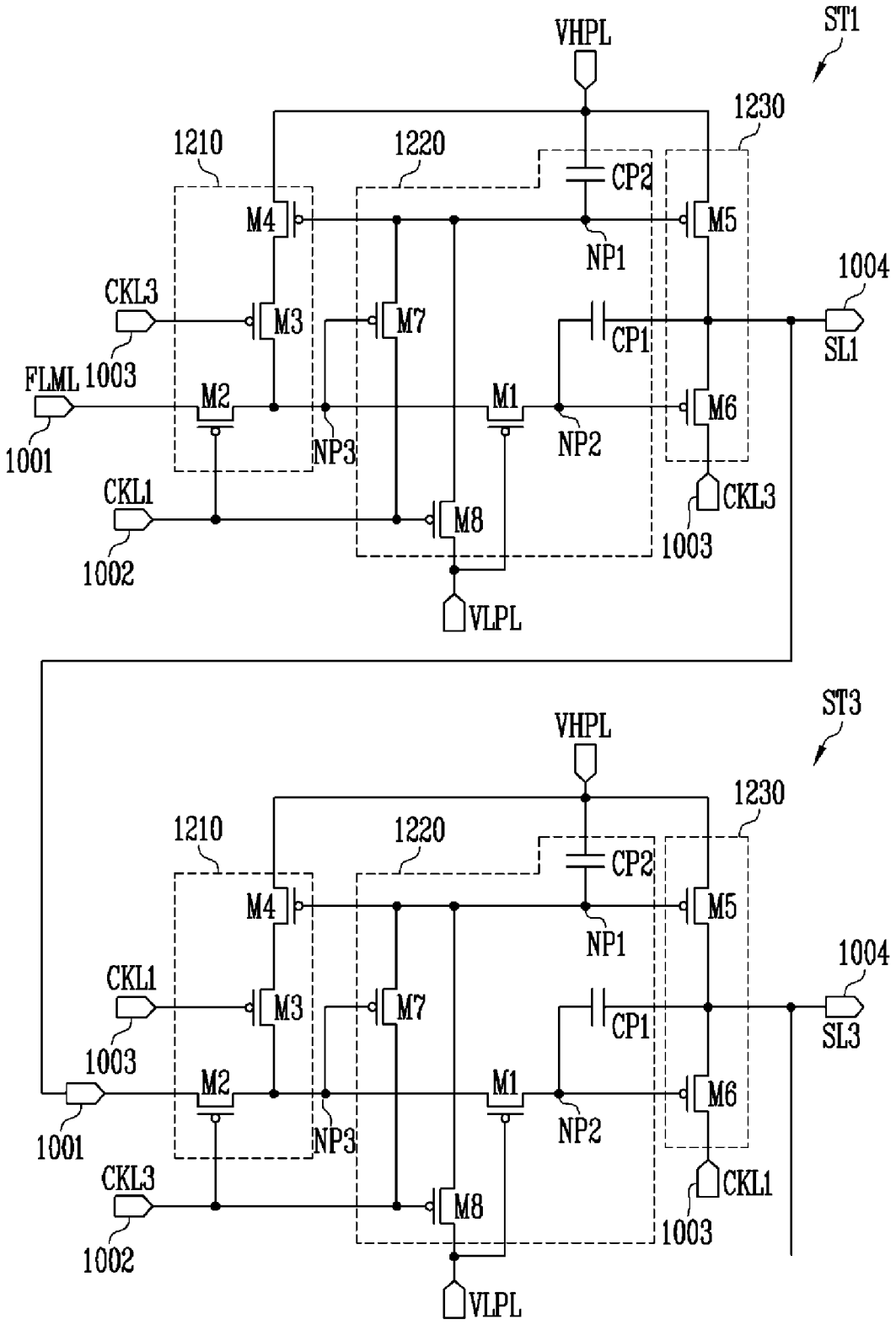
FIG. 4 illustrates a schematic view for explaining a stage according to an embodiment of the present disclosure.

FIG. 4 illustrates a schematic view for explaining a stage according to an embodiment of the present disclosure.

For better understanding and ease of description, FIG. 4 illustrates the first start stage ST1 and the second start stage ST2. Referring to FIG. 4, the first start stage ST1 may include a first driver 1210, a second driver 1220, and an output portion (buffer) 1230.

The output portion 1230 controls a voltage supplied to the output terminal 1004 in response to voltages of a node NP1 and a node NP2. To this end, the output portion 1230 includes a transistor M5 and a transistor M6.

The transistor M5 is disposed between the power line VHPL and the output terminal 1004, and a gate electrode thereof is connected to the node NP1. The transistor M5 controls connection between the power line VHPL and the output terminal 1004 in response to a voltage applied to the node NP1.

The transistor M6 is disposed between the output terminal 1004 and the third input terminal 1003, and a gate electrode thereof is connected to the node NP2. The transistor M6 controls connection between the output terminal 1004 and the third input terminal 1003 in response to a voltage applied to the node NP2. The output unit 1230 is driven as a buffer. Additionally, the transistors M5 and M6 may be configured by connecting a plurality of transistors in parallel.

The first driver 1210 controls a voltage of the node NP3 in response to signals supplied to the first input terminal 1001 to the third input terminal 1003. To this end, the first driver 1210 includes transistors M2, M3, and M4.

The transistor M2 is disposed between the first input terminal 1001 and the node NP3, and a gate electrode thereof is connected to the second input terminal 1002. The transistor M2 controls connection between the first input terminal 1001 and the node NP3 in response to a signal supplied to the second input terminal 1002.

The transistor M3 and the transistor M4 are connected in series and disposed between the node NP3 and power line VHPL. The transistor M3 is disposed between the transistor M4 and the node NP3, and a gate electrode thereof is connected to the third input terminal 1003. The transistor M3 controls connection between the transistor M4 and the node NP3 in response to a signal supplied to the third input terminal 1003.

The transistor M4 is disposed between the transistor M3 and the power line VHPL, and the gate electrode thereof is connected to the node NP1. The transistor M4 controls connection between the transistor M3 and the power line VHPL in response to a voltage of the node NP1.

The second driver 1220 controls a voltage of the node NP1 in response to voltages of the second input terminal 1002 and the node NP3. To this end, the second driver 1220 includes a transistor M1, a transistor M7, a transistor M8, a capacitor CP1, and a capacitor CP2.

The capacitor CP1 is connected between the node NP2 and the output terminal 1004. The capacitor CP1 is charged with a voltage corresponding to the turn-on and turn-off of the transistor M6.

The capacitor CP2 is connected between the node NP1 and the power line VHPL. The capacitor CP2 is charged with a voltage applied to the node NP1.

The transistor M7 is disposed between the node NP1 and the second input terminal 1002, and a gate electrode thereof is connected to the node NP2. The transistor M7 controls connection between the node NP1 and the second input terminal 1002 in response to a voltage of the node NP3.

The transistor M8 is disposed between the node NP1 and the power line VLPL, and a gate electrode thereof is connected to the second input terminal 1002. The transistor M8 controls connection between the node NP1 and the power line VLPL in response to a signal of the second input terminal 1002.

The transistor M1 is disposed between the node NP3 and the node NP2, and a gate electrode thereof is connected to the power line VLPL. The transistor M1 maintains an electrical connection between the node NP3 and the node NP2 while maintaining a turn-on state. Additionally, the transistor M1 limits a voltage drop width of the node NP3 in response to a voltage of the node NP2. In other words, even if a voltage of the node NP2 drops to a voltage lower than that of the power line VLPL, a voltage of the node NP3 is not lower than a voltage obtained by subtracting a threshold voltage of the transistor M1 from the voltage the power line VLPL.

Figure 5:
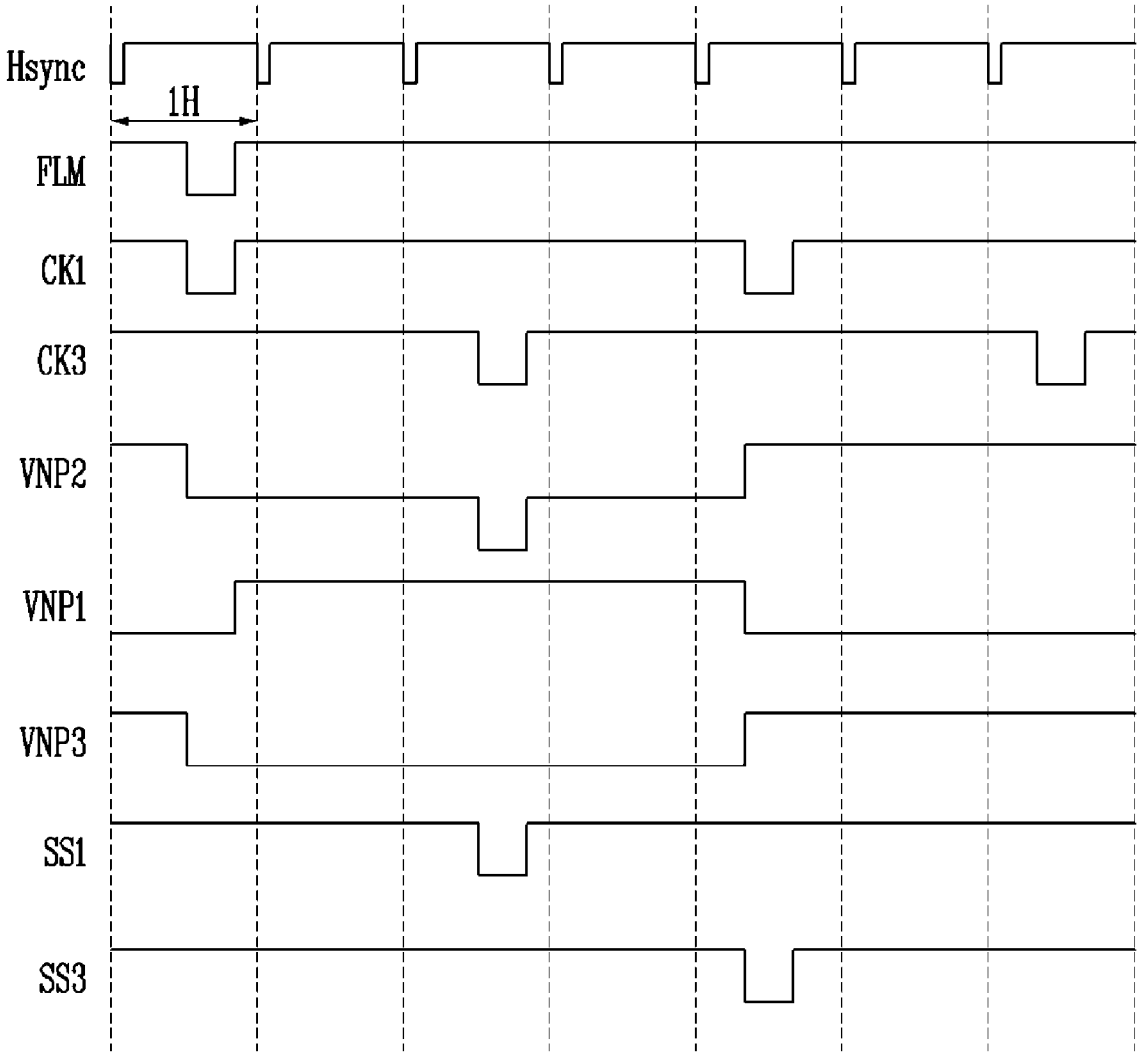
FIG. 5 illustrates a schematic view for explaining a driving method of a scan driver according to an embodiment of the present disclosure.

FIG. 5 illustrates a schematic view for explaining a driving method of a scan driver according to an embodiment of the present disclosure. In FIG. 5, for better comprehension and ease of description, an operation process will be described using the first start stage ST1.

Referring to FIG. 5, a first clock signal CK1 and a third clock signal CK3 have a period of 4 horizontal periods (4H), and are supplied in different horizontal periods. In other words, the first clock signal CK3 is set as a signal shifted by half a period (that is, 2 horizontal periods) from the first clock signal CK1. In addition, the scan start signal FLM supplied to the first input terminal 1001 may be supplied in synchronization with the first clock signal CK1 supplied to the second input terminal 1002. One horizontal period (1H) may correspond to a period of pulses of a horizontal synchronization signal Hsync.

Supply of specific signals may mean that specific signals have a turn-on level (here, a logic low level). Stopping the supply of specific signals may mean that the specific signals have a turn-off level (here, a logic high level).

Additionally, when the scan start signal FLM is supplied, the first input terminal 1001 may be set to a voltage of the logic low level, and when the scan start signal FLM is not supplied, the first input terminal 1001 may be set to a voltage of the logic high level. In addition, when a clock signal is supplied to the second input terminal 1002 and the third input terminal 1003, the second input terminal 1002 and the third input terminal 1003 may be set to a voltage of the logic low level, and when the clock signal is not supplied thereto, the second input terminal 1002 and the third input terminal 1003 may be set to a voltage of the logic high level, When the operation process is described in detail, the scan start signal FLM is first supplied to be synchronized with the first clock signal CK1.

When the first clock signal CK1 is supplied, the transistors M2 and M8 are turned on. When the transistor M2 is turned on, the first input terminal 1001 and the node NP3 are electrically connected. Here, since the transistor M1 is turned on in most of the period, the node NP2 maintains an electrical connection with the node NP3.

When the first input terminal 1001 and the node NP3 are electrically connected, voltages VNP2 and VNP3 of the nodes NP3 and NP2 are set to the low levels by the scan start signal FLM supplied to the first input terminal 1001. When the voltages VNP2 and VNP3 of the nodes NP3 and NP2 are set to the low levels, the transistors M6 and M7 are turned on.

When the transistor M6 is turned on, the third input terminal 1003 and the output terminal 1004 are electrically connected. Here, the third input terminal 1003 is set to the high-level voltage (that is, the first clock signal CK3 is not supplied), and accordingly, the high-level voltage is also outputted to the output terminal 1004. When the transistor M7 is turned on, the second input terminal 1002 and the node NP1 are electrically connected. According to the first clock signal CK1 supplied to the second input terminal 1002, the voltage VNP1 of the node NP1 is set to the low level.

Additionally, when the first clock signal CK1 is supplied, the transistor M8 is turned on. When the transistor M8 is turned on, the voltage of the power line VLPL is supplied to the node NP1. Here, the voltage of the power line VLPL is set to the same (or similar) voltage as the low level of the first clock signal CK1, and accordingly, the node NP1 stably maintains the low level voltage.

When the node NP1 is set to the low-level voltage, the transistor M4 and the transistor M5 are turned on. When the transistor M4 is turned on, the power line VHPL and the transistor M3 are electrically connected. Here, since the transistor M3 is set to the turn-off state, the node NP3 stably maintains the low-level voltage even when the transistor M4 is turned on. When the transistor M5 is turned on, the voltage of the power line VHPL is supplied to the output terminal 1004. Here, the voltage of the power line VHPL is set to the same (or similar) voltage as the high level voltage supplied to the third input terminal 1003, and accordingly, the output terminal 1004 stably maintains the high level voltage.

Thereafter, the supply of the scan start signal FLM and the first clock signal CK1 is stopped. When the supply of the first clock signal CK1 is stopped, the transistors M2 and M8 are turned off. In this case, the transistor M6 and the transistor M7 maintain a turn-on state in response to a voltage stored in the capacitor CP1. That is, the node NP2 and the node NP3 maintain the low level voltage by the voltage stored in the capacitor CP1.

When the transistor M6 maintains the turn-on state, the output terminal 1004 and the third input terminal 1003 maintain their electrical connection. When the transistor M7 maintains the turn-on state, the node NP1 maintains an electrical connection with the second input terminal 1002. Here, the voltage of the second input terminal 1002 is set to the high level voltage in response to stopping of the supply of the first clock signal CK1, and accordingly, the voltage VNP1 of the node NP1 is also set to the high level voltage. When the high-level voltage is supplied to the node NP1, the transistors M4 and M5 are turned off.

Thereafter, the first clock signal CK3 is supplied to the third input terminal 1003. In this case, since the transistor M6 is set to the turn-on state, the first clock signal CK3 supplied to the third input terminal 1003 is supplied to the output terminal 1004. In this case, the output terminal 1004 outputs the first clock signal CK3 as a scan signal SS1 of a turn-on level to the first scan line SL1.

Meanwhile, when the first clock signal CK3 is supplied to the output terminal 1004, the voltage of the node NP2 is lowered to a voltage lower than that of the power line VLPL due to coupling of the capacitor CP1, and accordingly, the transistor M6 stably maintains the turn-on state.

Meanwhile, even if the voltage of the node NP2 is lowered, the node NP3 may approximately maintain the voltage of the power line VLPL (for example, a voltage obtained by subtracting a threshold voltage of the transistor M1 from the voltage of the power line VLPL) by the transistor M1.

After the first scan signal SS1 of the turn-on level is outputted to the first scan line SL1, the supply of the first clock signal CK3 is stopped. When the supply of the first clock signal CK3 is stopped, the output terminal 1004 outputs the high level voltage. In addition, the voltage VNP2 of the node NP2 increases to approximately the voltage of the power line VLPL in response to the high level voltage of the output terminal 1004.

Thereafter, the first clock signal CK1 is supplied. When the first clock signal CK1 is supplied, the transistors M2 and M8 are turned on. When the transistor M2 is turned on, the first input terminal 1001 and the node NP3 are electrically connected. In this case, the scan start signal FLM is not supplied to the first input terminal 1001, and accordingly, the node NP3 is set to the high level voltage. Therefore, the high level voltage is supplied to the node NP3 and the node NP2, and accordingly, the transistor M6 and the transistor M7 are turned off.

When the transistor M8 is turned on, the voltage of the power line VLPL is supplied to the node NP1, and accordingly, the transistors M4 and M5 are turned on. When the transistor M5 is turned on, the voltage of the power line VHPL is supplied to the output terminal 1004. Thereafter, the transistor M4 and the transistor M5 maintain the turn-on state corresponding to the voltage charged in the capacitor CP2, and accordingly, the output terminal 1004 stably receives the voltage of the power line VHPL.

Additionally, when the first clock signal CK3 is supplied, the transistor M3 is turned on. At this time, since the transistor M4 is set to the turn-on state, the voltage of the power line VHPL is supplied to the node NP3 and the node NP2. In this case, the transistors M6 and M7 are stably maintained in the turn-off state.

The first stage ST3 receives the output signal (that is, a scanning signal) of the first stage ST1 so as to be synchronized with the first clock signal CK3. In this case, the first stage ST3 outputs a first scan signal SS3 of the turn-on level to the first scan line SL3 so as to be synchronized with the first clock signal CK1. The first stages (ST1, ST3, . . . ) sequentially output the turn-on level scan signal to the first scan lines (SL1, SL3, . . . ) while repeating the above-described process.

The description of the first stages (ST1, ST3, . . . ) in FIG. 4 and FIG. 5 may be substantially equally applied to the second stages (ST2, ST4, . . . ). The stages and the driving method thereof of FIG. 4 and FIG. 5 are one example, and other conventional stages and driving methods may be used to configure embodiments of the present disclosure.

FIGS. 6, 7, 8, and 9 illustrate schematic views for explaining a first frame period and a second frame period according to an embodiment of the present disclosure.

Figure 6:
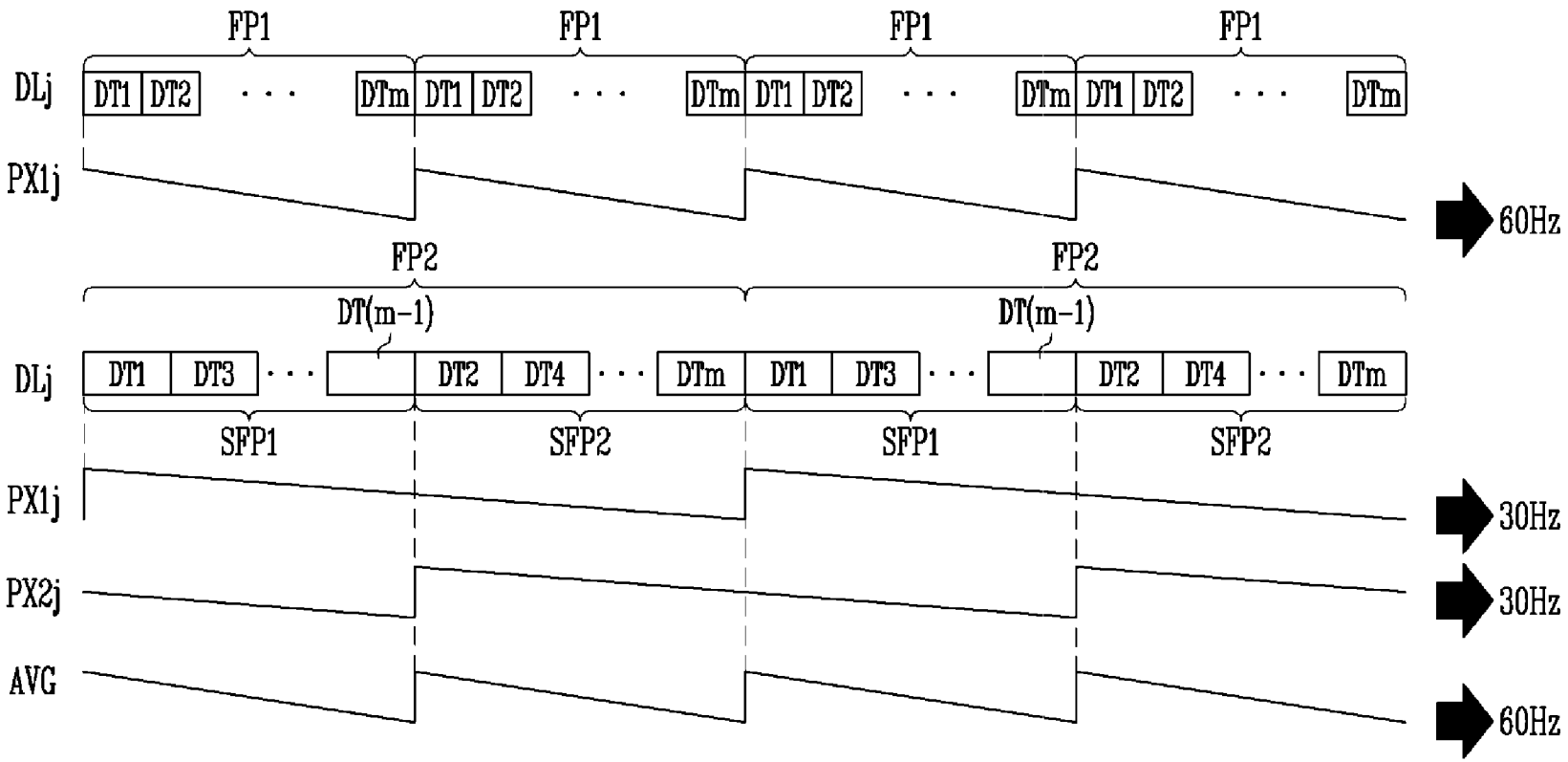
FIGS. 6, 7, 8, and 9 illustrate schematic views for explaining a first frame period and a second frame period according to an embodiment of the present disclosure.

The display device 10 may operate in a first display mode including a plurality of first frame periods FP1, or may operate in a second display mode including a plurality of second frame periods FP2. The second frame period FP2 may be longer than the first frame period FP1. For example, the second frame period FP2 may be an integer multiple of the first frame period FP1. For example, the second frame period FP2 may be 2p times the first frame period FP1, and p may be an integer larger than 0. In the embodiment of FIG. 6, the second frame period FP2 is twice the first frame period FP1.

The first display mode is suitable for displaying a moving picture by displaying input images (frames) at a high frequency, and the second display mode is suitable for displaying a still image by displaying the input images at a low frequency. When a still image is detected while displaying a moving picture, the display device 10 may switch from the first display mode to the second display mode. In addition, when a moving picture is detected while displaying a still image, the display device 10 may switch from the second display mode to the first display mode.

Referring to FIG. 6, for convenience of description, the j-th data line DLj and the pixels PX1*j* and PX2*j* will be mainly described. The example first pixel PX1*j* is connected to the j-th data line and the first scan line SL1. The first pixel PX1*j* is included in the first dot. The example second pixel PX2*j* is connected to the j-th data line and the second scan line SL2. The second pixel PX2*j* is included in the second dot.

In each first frame period FP1, the data driver 12 may sequentially apply data voltages corresponding to scan lines to data lines. For example, the data driver 12 may sequentially apply data voltages (DT1, DT2, . . . , DT(m−1), DTm) to the j-th data line DLj. Assuming that the first frame period FP1 is 1/60 second, the first data voltage DT1 may be supplied to the first pixel PX1*j* at 60 Hz. Accordingly, the first pixel PX1*j* emits light with a highest luminance at a time point at which the first data voltage DT1 is applied, and then luminance may gradually decrease due to a leakage current. Referring to FIG. 6, a luminance waveform of the first pixel PX1*j* corresponding to the plurality of first frame periods FP1 is illustrated as an example.

Each second frame period FP2 may include a first sub-frame period SFP1 and a second sub-frame period SFP2. Lengths of the first sub-frame period SFP1 and the second sub-frame period SFP2 may be the same. For example, assuming that the second frame period FP2 is 1/30 second, each of the first sub-frame period SFP1 and the second sub-frame period SFP2 may be 1/60 second.

In each first sub-frame period SFP1, the data driver 12 may sequentially apply data voltages corresponding to the first dots to data lines. For example, the data driver 12 may sequentially apply data voltages (DT1, DT3, . . . , DT(m−1)) to the j-th data line DLj. In each second sub-frame period SFP2, the data driver 12 may sequentially apply data voltages corresponding to the second dots to data lines. For example, the data driver 12 may sequentially apply data voltages (DT2, DT4, . . . , DTm) to the j-th data line DLj.

Accordingly, the first data voltage DT1 may be supplied to the first pixel PX1*j* at 30 Hz. Accordingly, the first pixel PX1*j* emits light with a highest luminance at a time point at which the first data voltage DT1 is applied, and then luminance may gradually decrease due to a leakage current. Referring to FIG. 6, a luminance waveform of the first pixel PX1*j* corresponding to the plurality of second frame periods FP2 is illustrated as an example. In addition, the second data voltage DT2 may be applied to the second pixel PX2*j* at 30 Hz. Accordingly, the second pixel PX2*j* emits light with a highest luminance at a time point at which the second data voltage DT2 is applied, and then luminance may gradually decrease due to a leakage current. Referring to FIG. 6, a luminance waveform of the second pixel PX2*j* corresponding to the plurality of second frame periods FP2 is illustrated as an example.

In this case, since the first pixel PX1*j* and the second pixel PX2*j* are positioned to be adjacent to each other, the first data voltage DT1 and the second data voltage DT2 in a typical input image may be substantially the same or similar.

Since a point of time at which the first pixel PX1*j* has the highest luminance and a point of time at which the second pixel PX2*j* has the highest luminance are alternately positioned, a user may recognize an average luminance waveform AVG of the first pixel PX1*j* and the second pixel PX2*j* as 60 Hz. Therefore, even when the first display mode and the second display mode are switched, it is possible to prevent a flicker due to a difference in the luminance waveform from being viewed.

Figure 7:
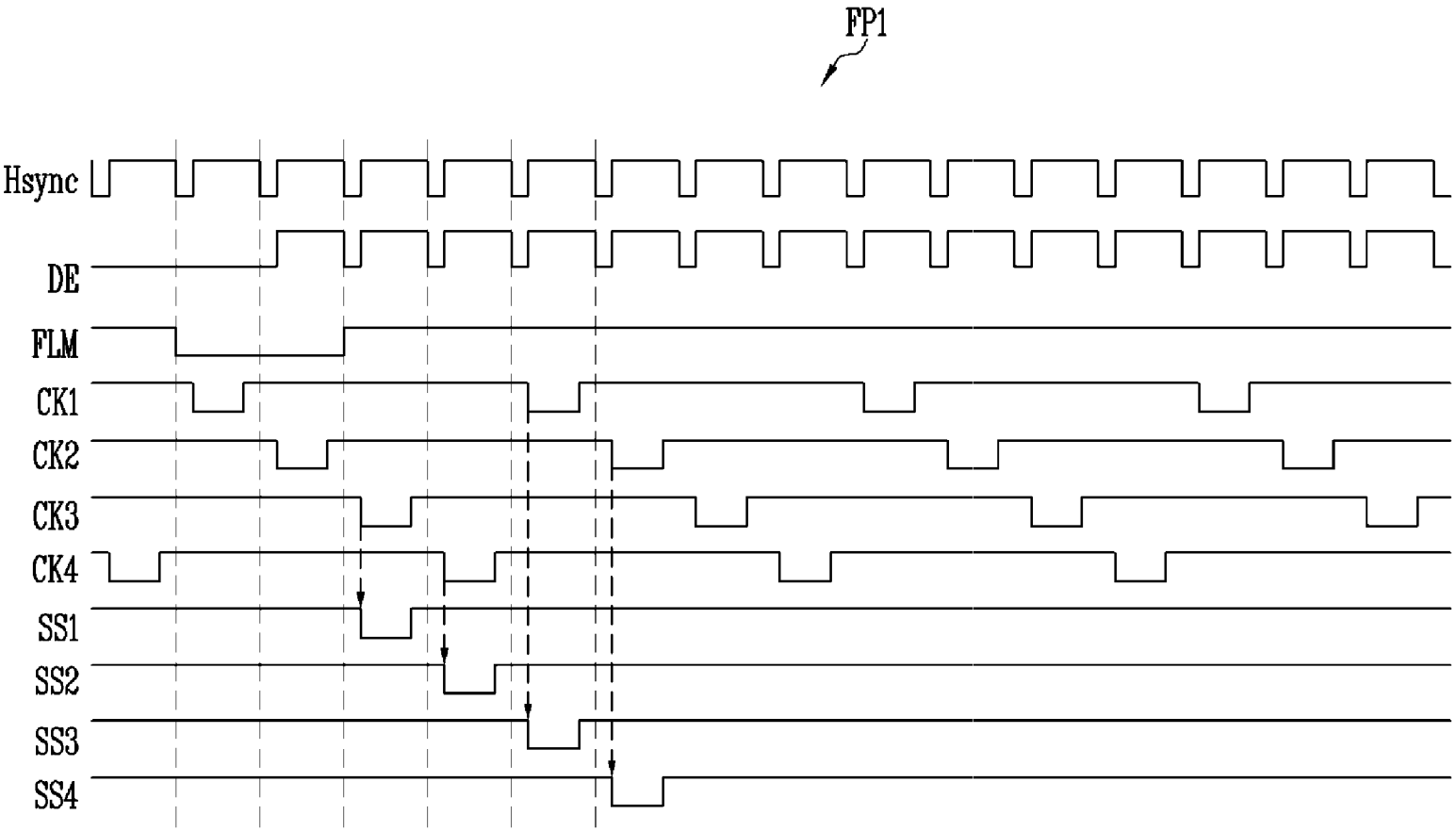

Referring to FIG. 7, control signals in the first frame period FP1 are exemplarily illustrated.

During the first frame period FP1, the timing controller 11 may apply the first clock signals CK1 and CK3 of the turn-on level to the first clock lines CKL1 and CKL3, and may apply the second clock signals CK2 and CK4 of the turn-on level to the second clock lines CKL2 and CKL4. The first clock signals CK1 and CK3 and the second clock signals CK2 and CK4 may have different phases. For example, the clock signals CK1, CK2, CK3, and CK4 of the turn-on level may be sequentially supplied in the order of the first clock line CKL1, the second clock line CKL2, the first clock line CKL3, and the second clock line CKL4. For example, each period of the clock signals CK1, CK2, CK3, and CK4 of the turn-on level may be 4 horizontal periods.

In addition, the timing controller 11 may apply the scan start signal FLM of the turn-on level to the scan start line FLML. In this case, a length of the scan start signal FLM of the turn-on level may be set to overlap the first clock signal CK1 of the turn-on level and the second clock signal CK2 of the turn-on level. For example, the length of the scan start signal FLM of the turn-on level may be 2 horizontal periods.

During the first frame period FP1, the scan driver 13 may alternately apply the scan signals (SS1, SS2, SS3, SS4, . . . ) of the turn-on level to the first scan lines (SL1, SL3, . . . ) and the second scan lines (SL2, SL4, . . . ).

Referring to the driving method of FIG. 5, the first scan signal SS1 of the turn-on level may be generated corresponding to the first clock signal CK3 of the turn-on level. In addition, the second scan signal SS2 of the turn-on level may be generated corresponding to the second clock signal CK4 of the turn-on level. Similarly, the first scan signal SS3 of the turn-on level may be generated corresponding to the first clock signal CK1 of the turn-on level. In addition, the second scan signal SS4 of the turn-on level may be generated corresponding to the second clock signal CK2 of the turn-on level.

The data driver 12 may supply data voltages to synchronize with respective scan signals (SS1, SS2, SS3, SS4, . . . ) of the turn-on level. For example, the data driver 12 may supply the data voltages in the current horizontal period corresponding to grays latched by a data enable signal DE of the logic high level of the previous horizontal period.

Figure 8:
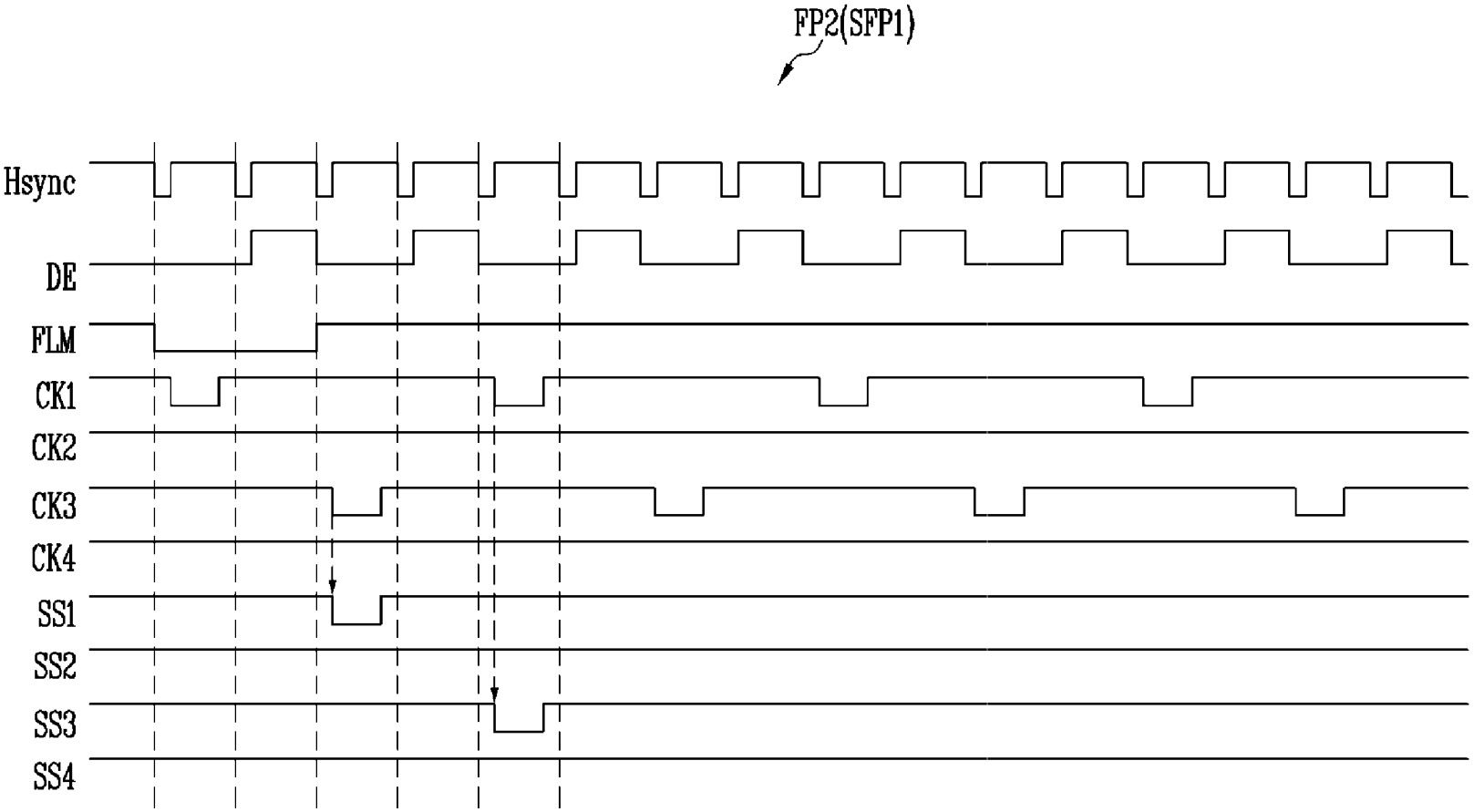

Referring to FIG. 8, control signals in the first sub-frame period SFP1 of the second frame period FP2 are exemplarily shown.

During the first frame period SFP1, the timing controller 11 may apply the first clock signals CK1 and CK3 of the turn-on level to the first clock lines CKL1 and CKL3, and may maintain the second clock signals CK2 and CK4 of the turn-off level to the second clock lines CKL2 and CKL4. In the first frame period FP1 and the first sub-frame period SFP1, periods of applying the first clock signals (CK1, CK3 . . . ) of the turn-on level to the first clock lines (CKL1, CKL3 . . . ) may be the same. For example, each period of the first clock signals CK1 and CK3 of the turn-on level may be 4 horizontal periods.

In addition, the timing controller 11 may apply the scan start signal FLM of the turn-on level to the scan start line FLML. In this case, a length of the scan start signal FLM of the turn-on level may be set to overlap the first clock signal CK1 of the turn-on level. For example, the length of the scan start signal FLM of the turn-on level may be 2 horizontal periods as shown, but may be set to 1 horizontal period.

During the first sub-frame period SFP1, the scan driver 13 may apply the first scan signals (SS1, SS3, . . . ) of the turn-on level to the first scan lines (SL1, SL3, . . . ), and may maintain the second scan signals (SS2, SS4, . . . ) of the turn-off level to the second scan lines (SL2, SL4, . . . ). In the first frame period FP1 and the first sub-frame period SFP1, periods of applying the first scan signals (SS1, SS3, . . . ) of the turn-on level to the first scan lines (SL1, SL3, . . . ) may be the same.

The data driver 12 may supply data voltages to synchronize with respective first scan signals (SS1, SS3, . . . ) of the turn-on level. In this case, since it is not necessary to supply data voltages to be synchronized with the second scan signals (SS2, SS4, . . . ), the period of the data enable signal DE of the turn-on level in the first sub-frame period SFP1 may be longer than that of the data enable signal DE of the turn-on level in the first frame period FP1. Accordingly, since the period in which the data driver 12 changes the data voltages increases, there is an advantage that the dynamic power required by the data driver 12 decreases.

Figure 9:
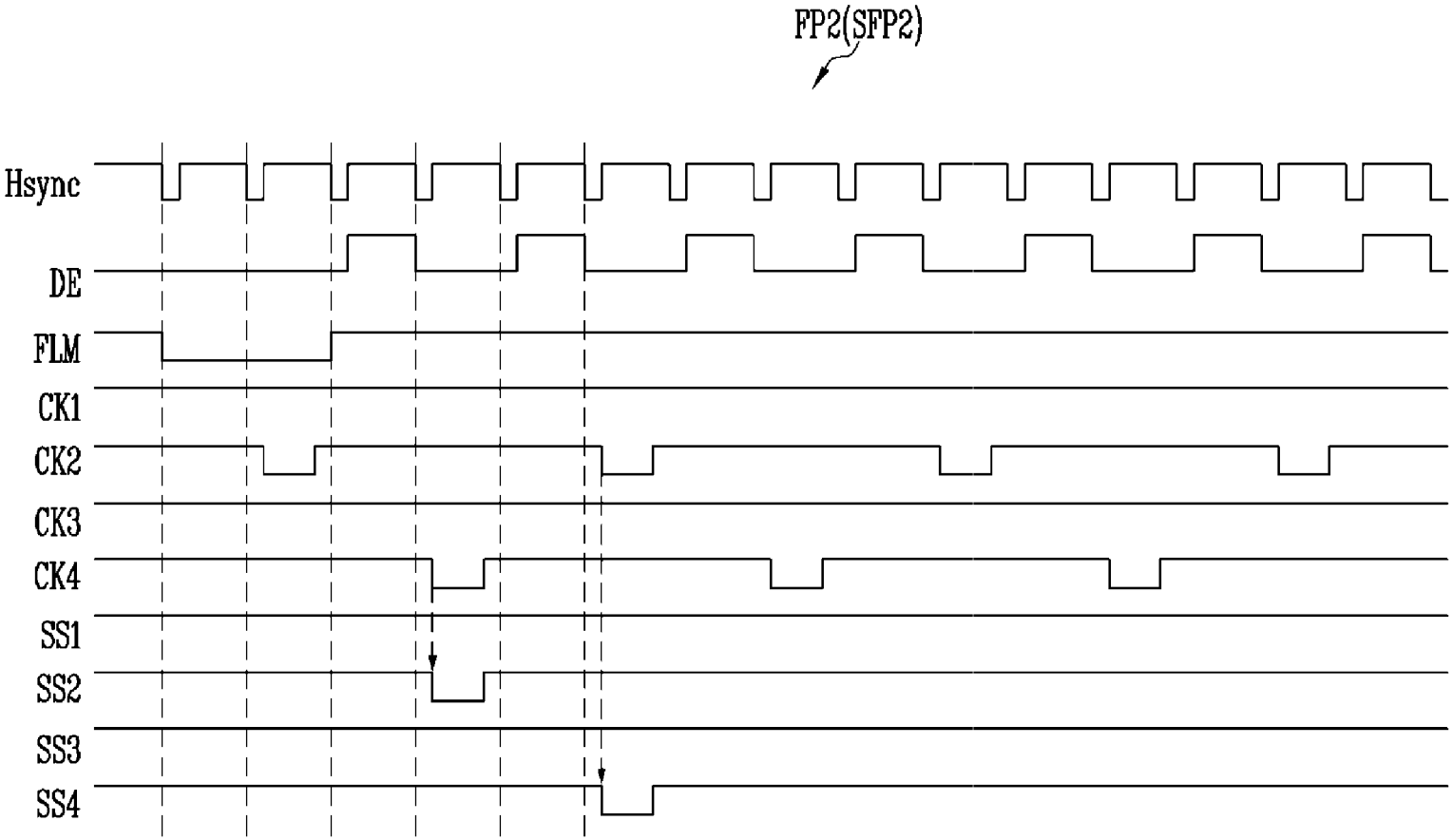

Referring to FIG. 9, control signals in the second sub-frame period SFP2 of the second frame period FP2 are shown as an example.

During the second sub-frame period SFP2, the second clock signals CK2 and CK4 of the turn-on level may be applied to the second clock lines CKL2 and CKL4 and the first clock signals CK1 and CK3 of the turn-off level may be maintained to the first clock lines CKL1 and CKL3. In the first frame period FP1 and the second sub-frame period SFP2, periods of applying the second clock signals (CK2, CK4 . . . ) of the turn-on level to the second clock lines (CKL2, CKL4 . . . ) may be the same. For example, each period of the second clock signals CK2 and CK4 of the turn-on level may be 4 horizontal periods.

In addition, the timing controller 11 may apply the scan start signal FLM of the turn-on level to the scan start line FLML. In this case, a length of the scan start signal FLM of the turn-on level may be set to overlap the second clock signal CK2 of the turn-on level. For example, the length of the scan start signal FLM of the turn-on level may be 2 horizontal periods as shown, but may be set to 1 horizontal period.

During the second sub-frame period SFP2, the scan driver 13 may apply the second scan signals (SS2, SS4, . . . ) of the turn-on level to the second scan lines (SL2, SL4, . . . ), and may maintain the first scan signals (SS1, SS3, . . . ) of the turn-off level to the first scan lines (SL1, SL3, . . . ). In the first frame period FP1 and the second sub-frame period SFP2, periods of applying the second scan signals (SS2, SS4, . . . ) of the turn-on level to the second scan lines (SL2, SL4, . . . ) may be the same.

The data driver 12 may supply data voltages to synchronize with respective second scan signals (SS2, SS4, . . . ) of the turn-on level. In this case, since it is not necessary to supply data voltages to be synchronized with the first scan signals (SS1, SS3, . . . ), the period of the data enable signal DE of the turn-on level in the second sub-frame period SFP2 may be longer than that of the data enable signal DE of the turn-on level in the first frame period FP1. Accordingly, since the period in which the data driver 12 changes the data voltages increases, there is an advantage that the dynamic power required by the data driver 12 decreases.

FIGS. 10, 11, 12, and 13 illustrate schematic views for explaining a first frame period and a second frame period according to another embodiment of the present disclosure.

Figure 10:
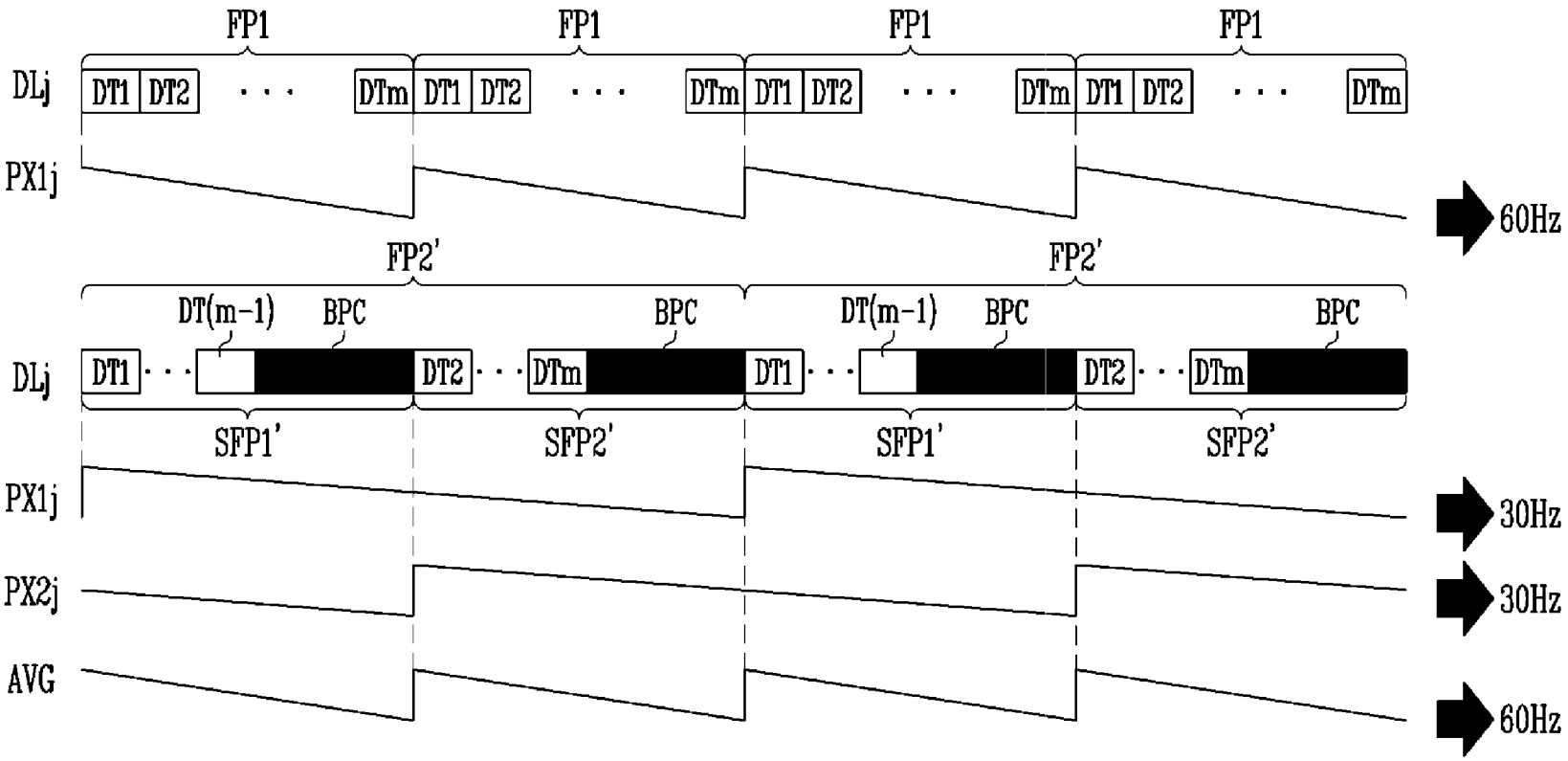
FIGS. 10, 11, 12, and 13 illustrate schematic views for explaining a first frame period and a second frame period according to another embodiment of the present disclosure.

In the embodiment of FIG. 10, a luminance waveform and a driving method of the first pixel PX1*j* in the first frame period FP1 are the same as those of FIG. 6. In addition, in the embodiment of FIG. 10, individual luminance waveforms and an average luminance waveform AVG of the first and second pixels PX1*j* and PX2*j* in a second frame period FP2' are substantially the same as those of FIG. 6.

However, the driving method of the second frame period FP2' of the embodiment of FIG. 10 is different from that of the embodiment of FIG. 6 in that each of a first sub-frame period SFP1' and a second sub-frame period SFP2' includes a data blank period BPC. For example, a length of each of the first sub-frame period SFP1' and the second sub-frame period SFP2' may be the same as that of each of the first sub-frame period SFP1 and the second sub-frame period SFP2, and the data driver 12 of the embodiment of FIG. 10 may supply data voltages with a shorter period than that of FIG. 6. The data blank period BPC may be a remaining period after the data driver 12 completes supplying the data voltages in each of the first sub frame period SFP1' and the second sub frame period SFP2'. During the data blank period BPC, all or at least a portion (a gamma amp or digital logic) of the data driver 12 is powered off, so that power consumption may be reduced.

Figure 11:
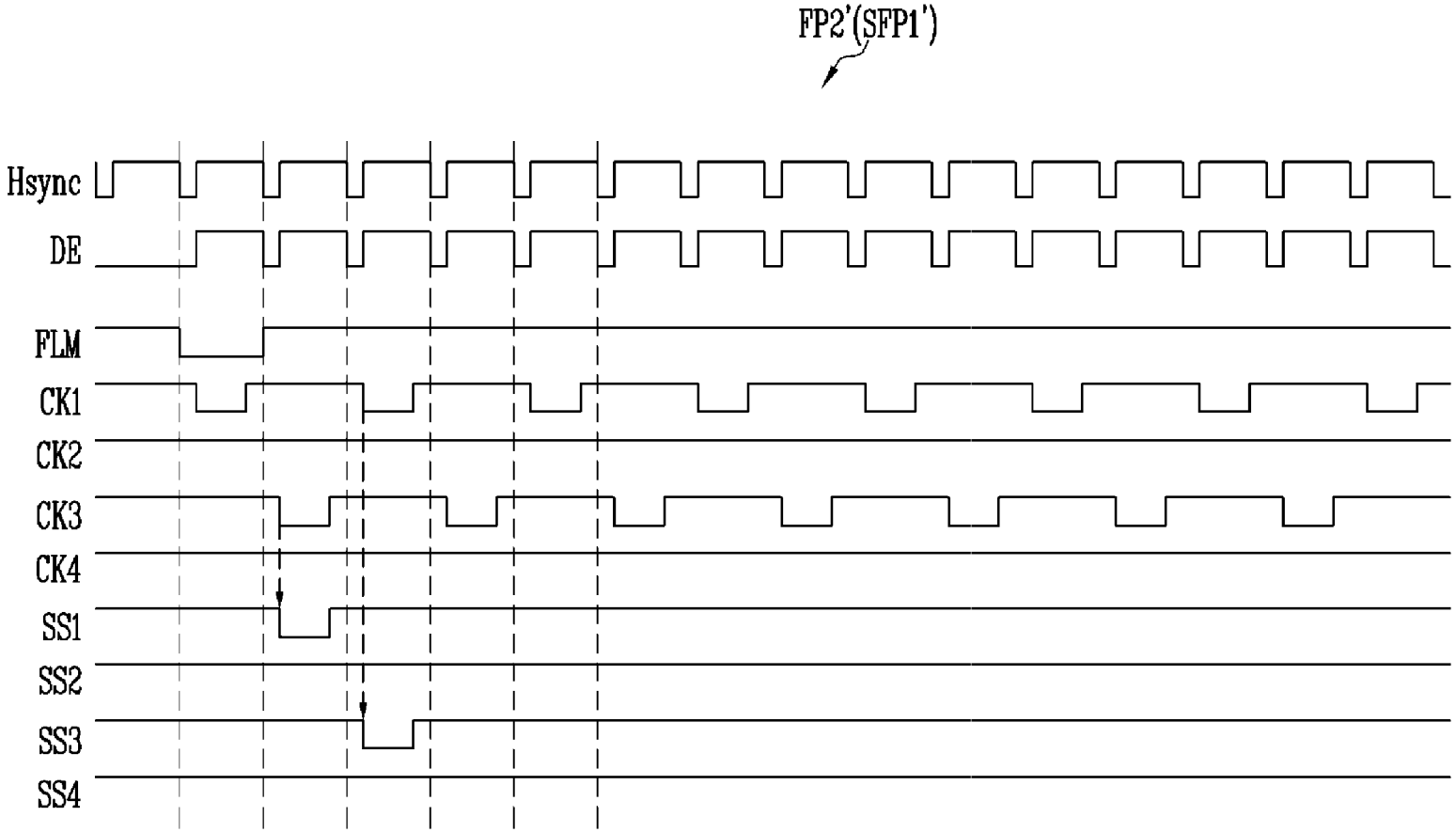

Referring to FIG. 11, control signals in the first sub-frame period SFP1' of the second frame period FP2' are exemplarily shown. Specifically, FIG. 11 shows control signals in a period excluding the data blank period BPC of the first sub-frame period SFP1'.

During the first-sub frame period SFP1', the timing controller 11 may apply the first clock signals CK1 and CK3 of the turn-on level to the first clock lines CKL1 and CKL3, and may maintain the second clock signals CK2 and CK4 of the turn-off level to the second clock lines CKL2 and CKL4. In the present embodiment, a cycle of applying the first clock signals CK1 and CK3 of the turn-on level to the first clock lines CKL1 and CKL3 in the first sub-frame period SFP1' may be shorter than a cycle of applying the first clock signals CK1 and CK3 of the turn-on level in the first frame period FP1.

For example, each period of the first clock signals CK1 and CK3 of the turn-on level may be 2 horizontal periods.

The timing controller 11 may apply the scan start signal FLM of the turn-on level to the scan start line FLML. In this case, a length of the scan start signal FLM of the turn-on level may be set to overlap the first clock signal CK1 of the turn-on level. For example, the length of the scan start signal FLM of the turn-on level may be set to 1 horizontal period.

During the first sub-frame period SFP1', the scan driver 13 may apply the first scan signals (SS1, SS3, . . . ) of the turn-on level to the first scan lines (SL1, SL3, . . . ), and may maintain the second scan signals (SS2, SS4, . . . ) of the turn-off level to the second scan lines (SL2, SL4, . . . ). A cycle of applying the first scan signals (SS1, SS3, . . . ) of the turn-on level to the first scan lines (SL1, SL3, . . . ) in the first sub-frame period SFP1' may be shorter than a cycle of applying the first scan signals (SS1, SS3, . . . ) of the turn-on level in the first frame period FP1.

The data driver 12 may supply data voltages to synchronize with respective first scan signals (SS1, SS3, . . . ) of the turn-on level.

Figure 12:
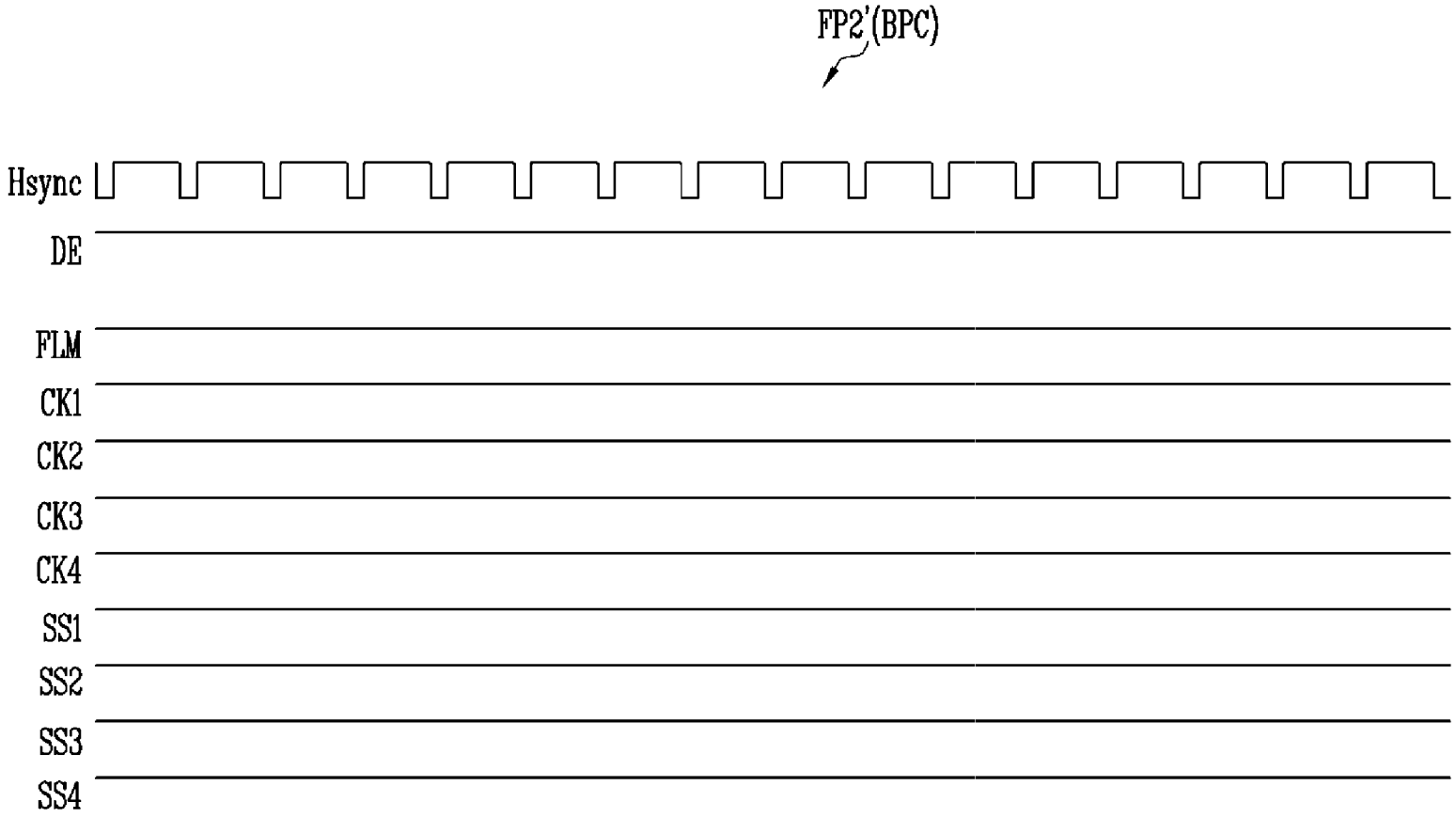

Referring to FIG. 12, control signals in the data blank period BPC of the second frame period FP2' are exemplarily shown. In the data blank period BPC, the clock signals CK1, CK2, CK3, and CK4 of the turn-off level, the scan signals (SS1, SS2, SS3, SS4, . . . ) of the turn-off level, and the scan start signal FLM of the turn-off level may be maintained.

As described above, during the data blank period BPC, all or at least a portion (a gamma amp or digital logic) of the data driver 12 is powered off, so that power consumption may be reduced.

Figure 13:
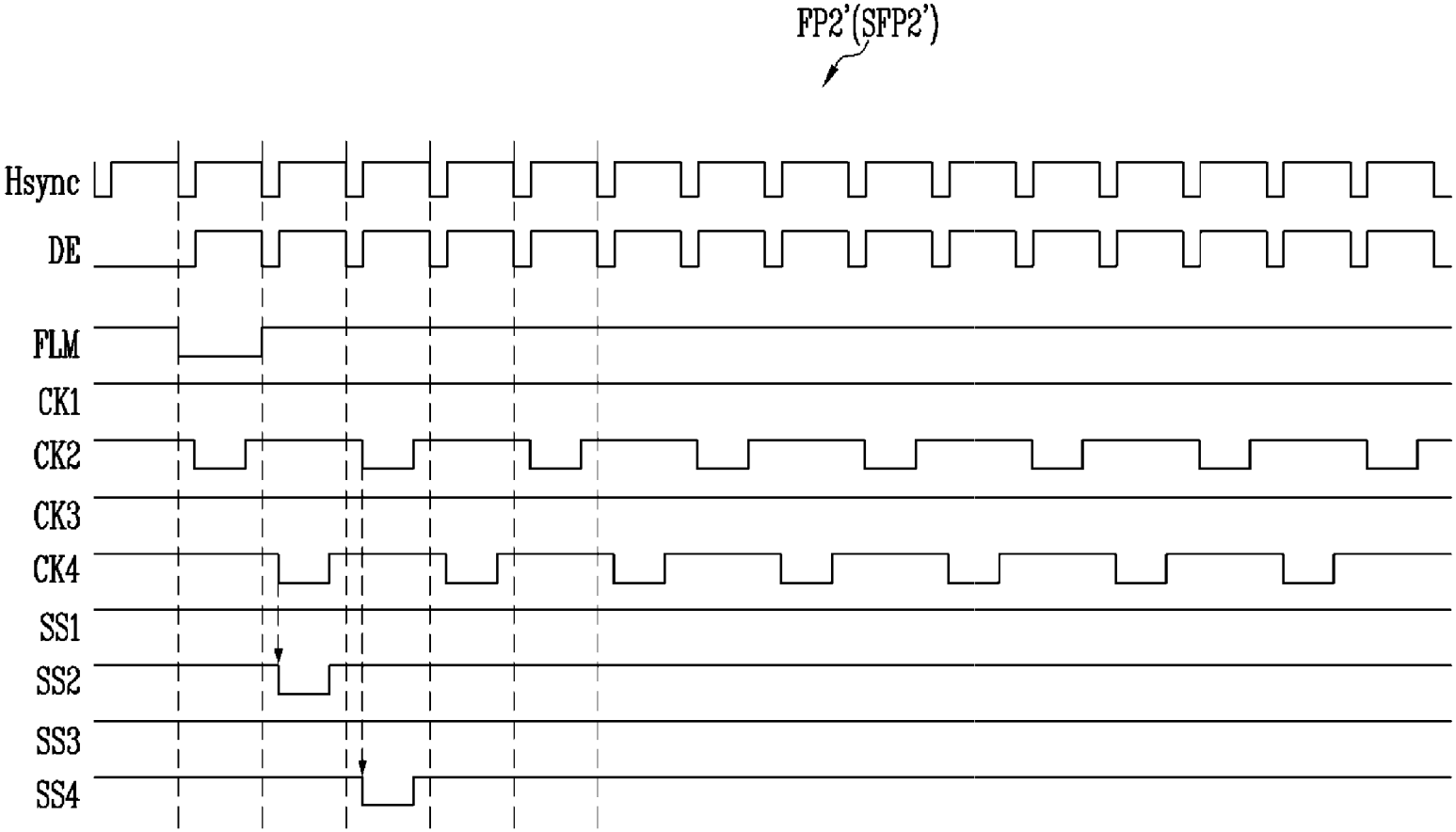

Referring to FIG. 13, control signals in the second sub-frame period SFP2' of the second frame period FP2' are exemplarily shown. Specifically, FIG. 13 shows control signals in a period excluding the data blank period BPC of the second sub-frame period SFP2'.

During the second sub-frame period SFP2', the second clock signals CK2 and CK4 of the turn-on level may be applied to the second clock lines CKL2 and CKL4 and the first clock signals CK1 and CK3 of the turn-off level may be maintained to the first clock lines CKL1 and CKL3. A period of applying the first clock signals CK2 and CK4 of the turn-on level to the second clock lines CKL2 and CKL4 in the second sub-frame period SFP2' may be shorter than a period of applying the second clock signals CK2 and CK4 of the turn-on level in the first frame period FP1. For example, each period of the second clock signals CK2 and CK4 of the turn-on level may be 2 horizontal periods.

In addition, the timing controller 11 may apply the scan start signal FLM of the turn-on level to the scan start line FLML. In this case, a length of the scan start signal FLM of the turn-on level may be set to overlap the second clock signal CK2 of the turn-on level. For example, the length of the scan start signal FLM of the turn-on level may be set to 1 horizontal period.

During the second sub-frame period SFP2', the scan driver 13 may apply the second scan signals (SS2, SS4, . . . ) of the turn-on level to the second scan lines (SL2, SL4, . . . ), and may maintain the first scan signals (SS1, SS3, . . . ) of the turn-off level to the first scan lines (SL1, SL3, . . . ). A period of applying the second scan signals (SS2, SS4, . . . ) of the turn-on level to the second scan lines (SL2, SL4, . . . ) in the second sub-frame period SFP2' may be shorter than a period of applying the second scan signals (SS2, SS4, . . . ) of the turn-on level in the first frame period FP1.

The data driver 12 may supply data voltages to synchronize with respective second scan signals (SS2, SS4, . . . ) of the turn-on level.

Figure 14:
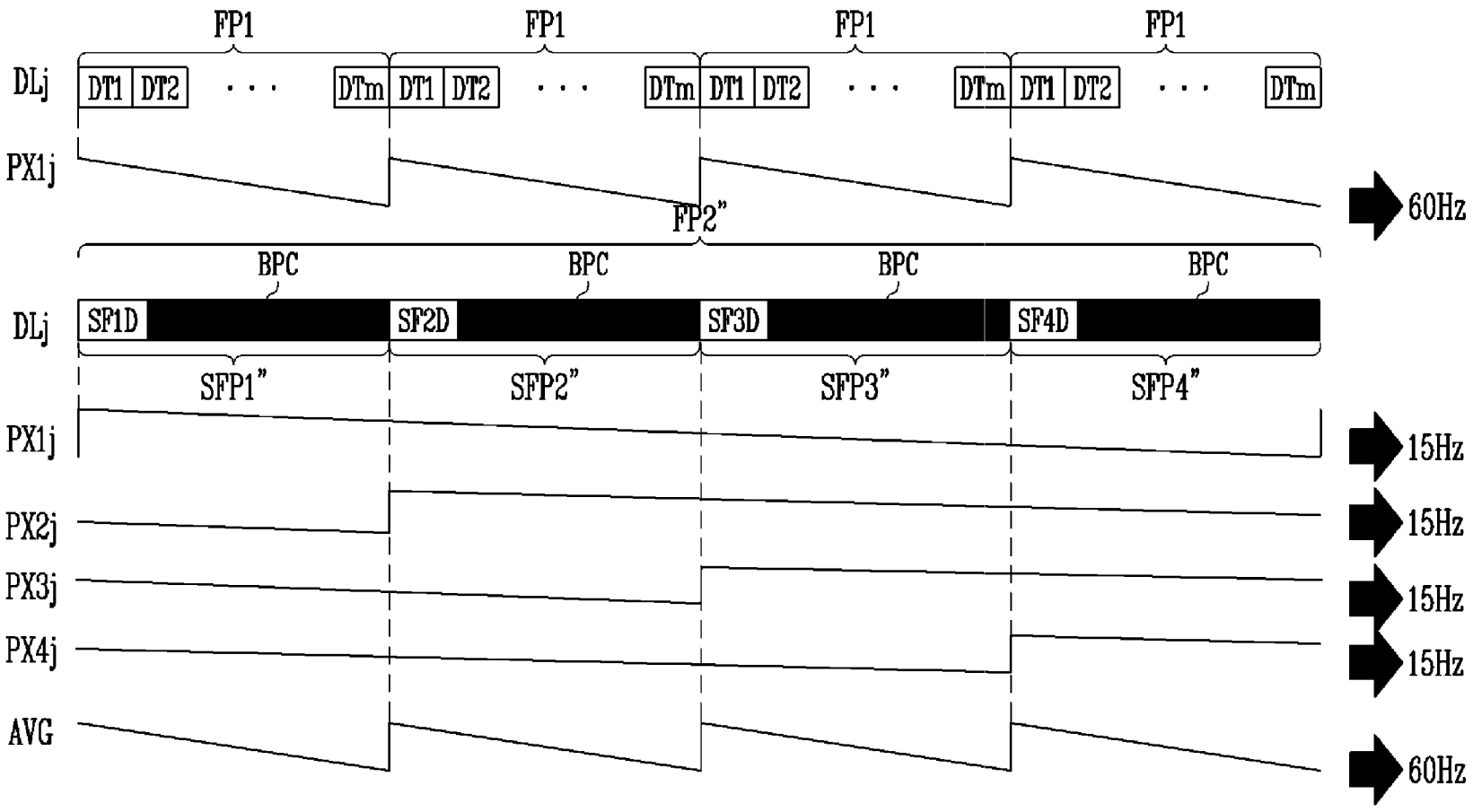
FIG. 14 illustrates a schematic view for explaining a first frame period and a second frame period according to another embodiment of the present disclosure.

FIG. 14 illustrates a schematic view for explaining a first frame period and a second frame period according to another embodiment of the present disclosure.

In the embodiment of FIG. 14, a luminance waveform and a driving method of the first pixel PX1*j* in the first frame period FP1 are the same as those of FIG. 6.

The driving method of the second frame period FP2" of FIG. 14 is similar to that of FIG. 10, but they are different in that each second frame period FP2" includes four sub-frame periods SFP1", SFP2", SFP3", and SFP4". For example, the second frame period FP2" is four times the first frame period FP1, and thus may be 1/15 second. For example, each of the sub-frame periods SFP1", SFP2", SFP3", and SFP4" may be 1/60 second.

In the embodiment of FIG. 10, two dots form a group, but in the embodiment of FIG. 14, there is a difference in that four adjacent dots form one group. The first pixel PX1*j* in the first dot may receive a data voltage SF1D in the first sub-frame period SFP1", and may emit light with the highest luminance. The second pixel PX2*j* in the second dot may receive a data voltage SF2D in the second sub-frame period SFP2", and may emit light with the highest luminance. A third pixel PX3*j* in a third dot may receive a data voltage SF3D in the third sub-frame period SFP3", and may emit light with the highest luminance. A fourth pixel PX4*j* in a fourth dot may receive a data voltage SF4D in the fourth sub-frame period SFP4", and may emit light with the highest luminance. Accordingly, even if each of the pixels PX1*j*, PX2*j*, PX3*j*, and PX4*j* emit light at 15 Hz, an average luminance waveform AVG of a group of pixels PX1*j*, PX2*j*, PX3*j*, and PX4*j* may be recognized as 60 Hz.

Referring to FIG. 10 and FIG. 14, the number of sub-frame periods SFP1", SFP2, SFP3, and SFP4" included in the second frame period FP2" may be variously set.

Figure 15:
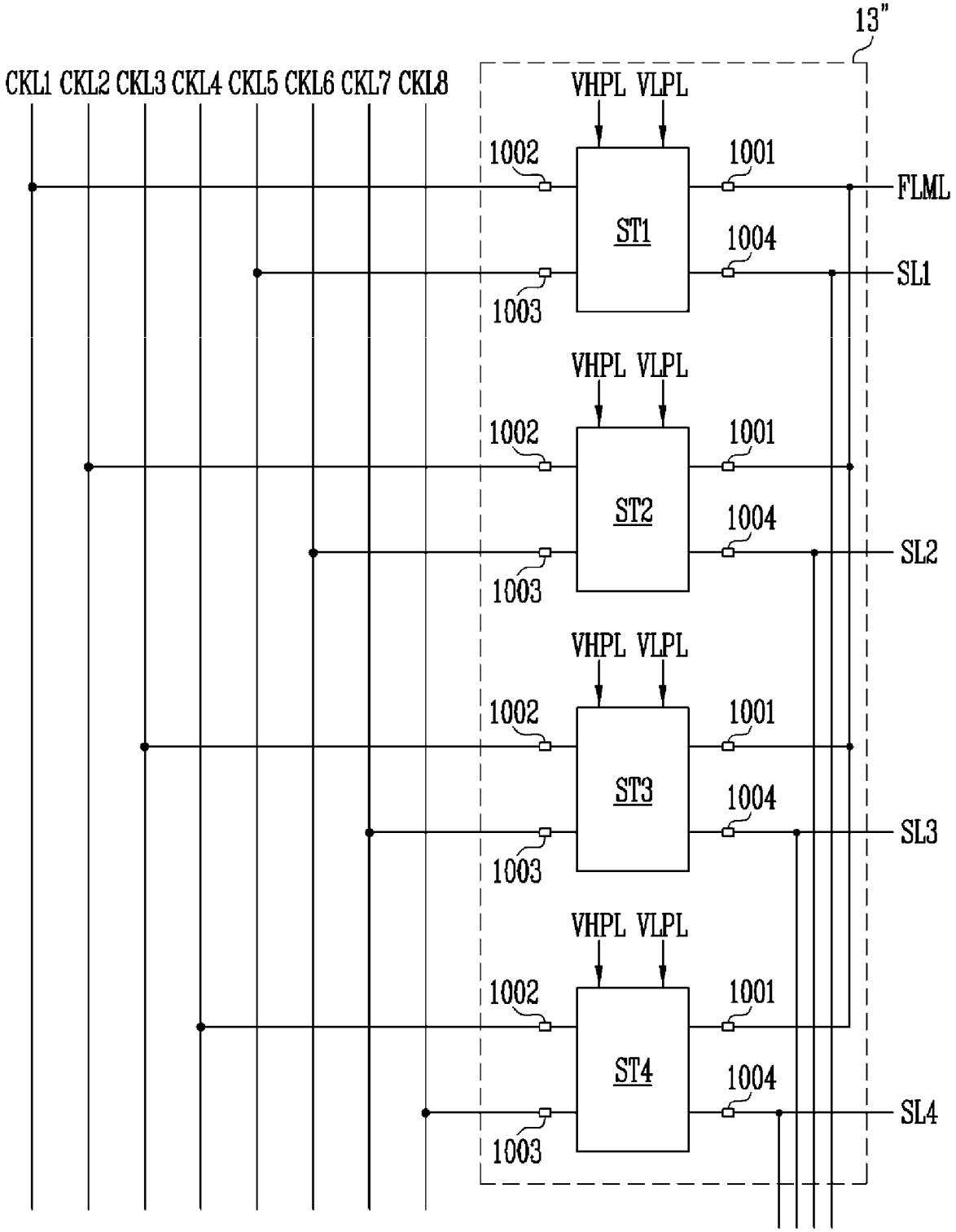
FIG. 15 illustrates a schematic view for explaining a scan driver according to another embodiment of the present disclosure.

FIG. 15 illustrates a schematic view for explaining a scan driver according to another embodiment of the present disclosure.

A scan driver 13" of FIG. 15 is one in which the scan driver 13 of FIG. 3 is partially modified in order to apply the driving method of FIG. 14. Internal circuit configurations of stages ST1, ST2, ST3, and ST4 of the scan driver 13" and the scan driver 13 may be the same.

However, unlike the scan driver 13 of FIG. 3 divided into two stage groups (odd-numbered stages and even-numbered stages), the scan driver 13" of FIG. 15 may be divided into four stage groups. For example, a first stage group includes (4q+1)-th stages (ST1, . . . ), and each of the stages (ST1, . . . ) may be alternately connected to the clock lines CKL1 and CKL5. In this case, q may be an integer larger than or equal to 0. That is, the second input terminal 1002 of the first start stage ST1 is connected to CKL1, and the third input terminal 1003 of the first start stage ST1 is connected to CKL5. A second stage group includes (4q+2)-th stages (ST2, . . . ), and each of the stages (ST2, . . . ) may be alternately connected to clock lines CKL2 and CKL6. That is, the second input terminal 1002 of the second start stage ST2 is connected to CKL2, and the third input terminal 1003 of the second start stage ST2 is connected to CKL6. A third stage group includes (4q+3)-th stages (ST3, . . . ), and each of the stages (ST3, . . . ) may be alternately connected to clock lines CKL3 and CKL7. That is, the second input terminal 1002 of the third start stage ST3 is connected to CKL3, and the third input terminal 1003 of the third start stage ST3 is connected to CKL7. A fourth stage group includes (4q+4)-th stages (ST4, . . . ), and each of the stages (ST4, . . . ) may be alternately connected to clock lines CKL4 and CKL8. That is, the second input terminal 1002 of the fourth start stage ST4 is connected to CKL4, and the third input terminal 1003 of the fourth start stage ST4 is connected to CKL8.

The first input terminal 1001 of each of the stages ST1, ST2, ST3, and ST4 may be connected to the scan start line FLML. The driving method of the scan driver 13" is similar to that of the scan driver 13, so a repeated description will be omitted.

Figure 16:
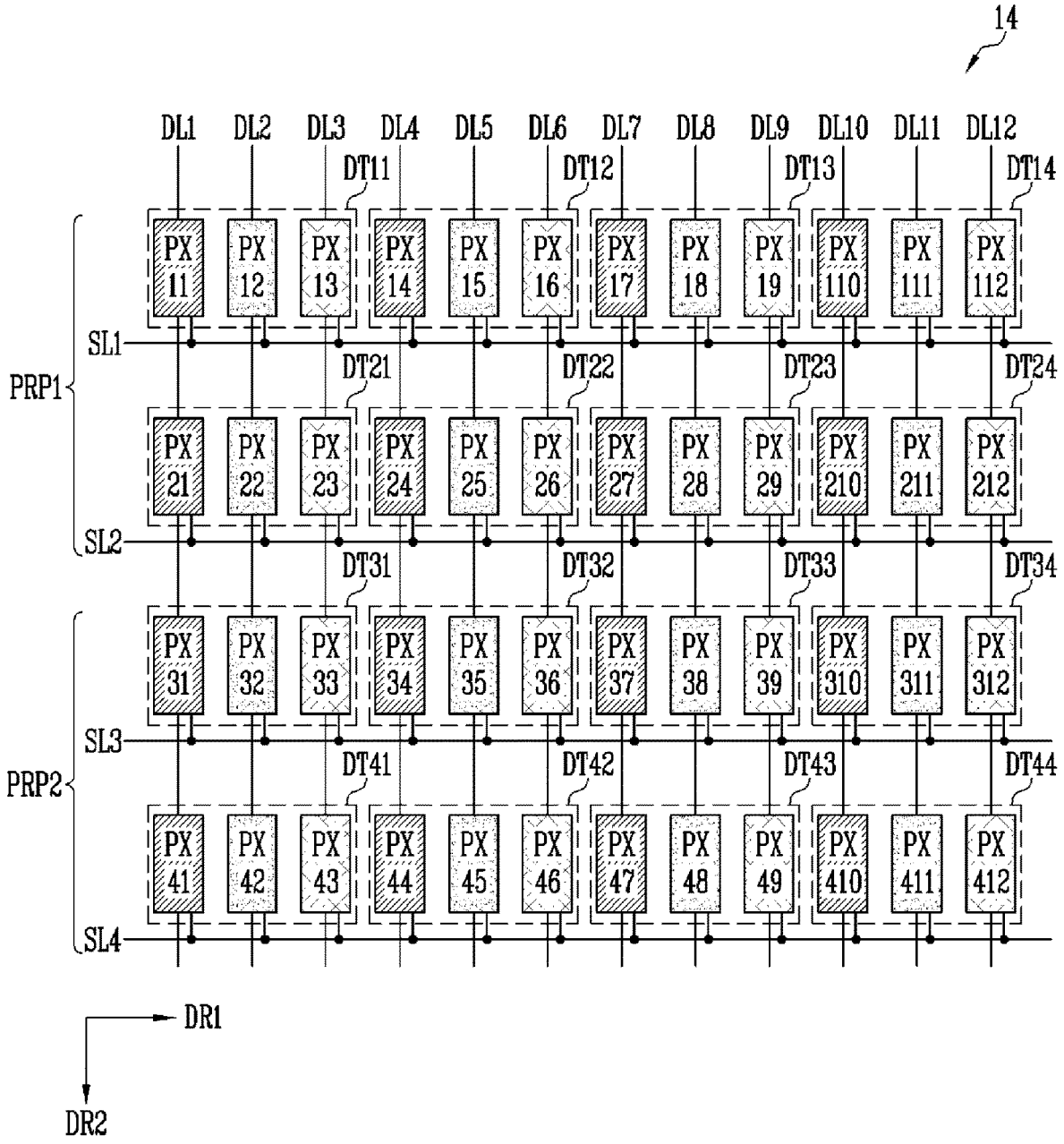
FIG. 16 illustrates a schematic view for explaining a pixel unit according to an embodiment of the present disclosure.

FIG. 16 illustrates a schematic view for explaining a pixel unit according to an embodiment of the present disclosure.

Referring to FIG. 16, a pixel unit 14 having an RGB stripe structure is illustrated as an example.

Each of the dots (DT11, DT12, DT13, DT14, DT21, DT22, DT23, DT24, DT31, DT32, DT33, DT34, DT41, DT42, DT43, and DT44) are a pixel of a first color, a pixel of a second color, and a pixel of a third color that are arranged in a first direction DR1. In this case, the first color, the second color, and the third color may be different from each other. For example, the first color may be red, the second color may be green, and the third color may be blue.

Here, the color of the pixel means the color when the light emitting diode LD of FIG. 2 emits light. In addition, the position of the pixel is described based on the position of the light emitting surface of the light emitting diode LD.

Each of the data lines (DL1, DL2, DL3, DL4, DL5, DL6, DL7, DL8, DL9, DL10, DL11, and DL12) may be connected to pixels of a single color. For example, the data lines (DL1, DL4, DL7, and DL10) may be respectively connected to red pixels (PX11, PX21, PX31, and PX41 for DL1, PX14, PX24, PX34, and PX44 for DL4, PX17, PX27, PX37, and PX47 for DL7, and PX110, PX210, PX310, and PX410 for DL10). In addition, the data lines (DL2, DL5, DL8, and DL11) may be respectively connected to green pixels (PX12, PX22, PX32, and PX42 for DL2, PX15, PX25, PX35, and PX45 for DL5, PX18, PX28, PX38, and PX48 for DL8, and PX111, PX211, PX311, and PX411 for DL11). In addition, the data lines (DL3, DL6, DL9, and DL12) may be respectively connected to blue pixels (PX13, PX23, PX33, and PX43 for DL3, PX16, PX26, PX36, and PX46 for DL6, PX19, PX29, PX39, and PX49 for DL9, and PX112, PX212, PX312, and PX412 for DL12).

Dots (DT11 to DT14 and DT31 to DT34) connected to the first scan lines SL1 and SL3 alternate with dots (DT21 to DT24 and DT41 to DT44) connected to the second scan lines SL2 and SL4 in a second direction DR2. In the embodiment of FIG. 16, the dots connected to the first scan lines SL1 and SL3 do not alternate with the dots connected to the second scan lines SL2 and SL4 in the first direction DR1. The first direction DR1 and the second direction DR2 may be orthogonal. However, in another embodiment, the first direction DR1 and the second direction DR2 may not be orthogonal.

Pixels connected to the same scan line may be referred to as one pixel row. For example, a first pixel row may indicate pixels PX11 to PX112 connected to the first scan line SL1 along the first direction DR1, a second pixel row may indicate pixels PX21 to PX212 connected to the second scan line SL2 along the first direction DR1, a third pixel row may indicate pixels PX31 to PX312 connected to the first scan line SL3 along the first direction DR1, and a fourth pixel row may indicate pixels PX41 to PX412 connected to the second scan line SL4 along the first direction DR1.

Each of the pixel rows may extend in the first direction DR1. In addition, odd numbered pixel rows (for example, the first pixel row and the third pixel row) and even numbered pixel rows (for example, the second pixel row and the fourth pixel row) may be alternately disposed in the second direction DR2. In addition, pixels included in each pixel row may be designated as a dot in two or more units. As described above, in the case of FIG. 16, each dot includes three pixels.

An odd numbered pixel row and an even numbered pixel row that are adjacent to each other may be defined as one pair. The pair may mean a pixel row pair. For example, in the case of FIG. 16, the first pixel row and the second pixel row may be defined as a first pair PRP1, and the third pixel row and the fourth pixel row may be defined as a second pair PRP2.

In another embodiment, the first pixel row and the second pixel row may be defined as a first pair, the second pixel row and the third pixel row may be defined as a second pair, and the third pixel row and the fourth pixel row may be defined as a third pair.

Figure 17:
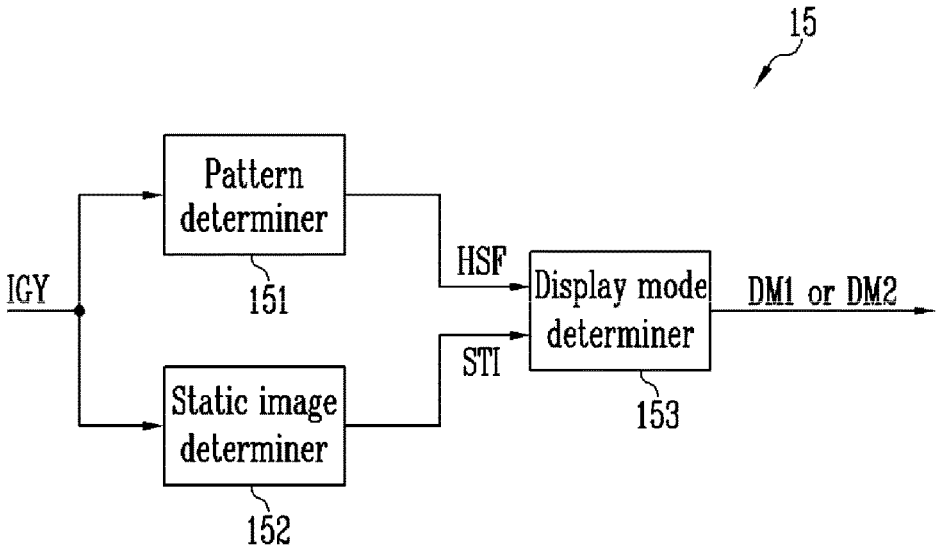
FIG. 17 illustrates a schematic view for explaining a display mode controller according to an embodiment of the present disclosure.

FIG. 17 illustrates a schematic view for explaining a display mode controller according to an embodiment of the present disclosure.

The display mode controller 15 according to an embodiment of the present disclosure may include a pattern determiner 151, a static image determiner 152, and a display mode determiner 153.

The pattern determiner 151 may generate a pattern detection signal HSF based on grays IGY for at least one input image. For example, the pattern determiner 151 may generate the pattern detection signal HSF when there is a predetermined pattern of a predetermined size or more by referring to the grays IGY of one input image. For example, the pattern determiner 151 may generate the pattern detection signal HSF when there is a predetermined pattern of a predetermined size or more by referring to the grays IGY of one input image and when luminance of the pattern is larger than reference luminance. Here, the size may be an area of a plane defined as a reference with the first direction DR1 and the second direction DR2 referenced in FIG. 16.

The still image determiner 152 may generate a still image detection signal STI when an input image is determined to be a still image based on the grays IGY of continuous input images. When it is determined that the grays IGY of the continuous input images are the same within a reference range, the still image determiner 152 may determine the continuous input images as a still image and generate the still image detection signal STI. When the grays IGY of the continuous input images are different from each other at the outside of the reference range, the still image determiner 152 may determine the continuous input images as a motion picture and generate a motion picture detection signal.

When both the still image detection signal STI and the pattern detection signal HSF are received, the display mode determiner 153 may generate a first display mode signal DM1. In this case, the display device 10 may operate in the first display mode described in FIGS. 6, 7, 8, 9, 10, 11, 12, 13, 14, and 15. Therefore, even if a still image is detected, when it is determined that there is a worst pattern such as a horizontal stripe pattern, a flicker phenomenon may be prevented by displaying the input images at a high frequency. In this case, the scan driver 13 may alternately provide turn-on level scan signals to the odd numbered pixel rows and the even numbered pixel rows (see FIG. 7).

In addition, when the display mode determiner 153 receives the still image detection signal STI but does not receive the pattern detection signal HSF, the display mode determiner 153 may generate a second display mode signal DM2. In this case, the display device 10 may operate in the second display mode described in FIG. 6 to FIG. 15. In this case, even if a still image is displayed at a low frequency, since no flicker occurs, power consumption may be reduced. In this case, the scan driver 13 may provide the turn-on level scan signals to the odd-numbered pixel rows during the first sub-frame period SFP1 (see FIG. 8), and may provide the turn-on level scan signals to the even-numbered pixel rows during the second sub-frame period SFP2 after the first sub-frame period SFP1 (see FIG. 9).

Figure 18:
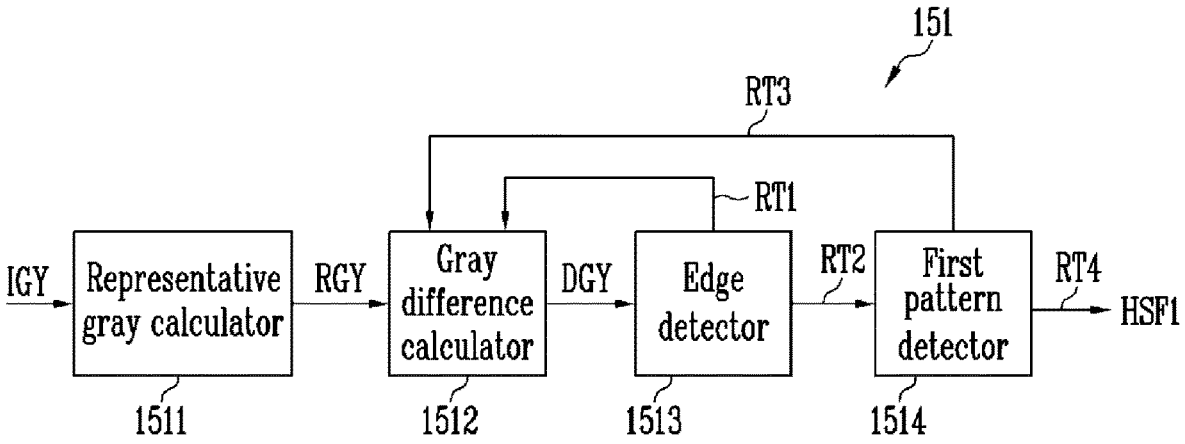
FIGS. 18, 19, and 20 illustrate schematic views for explaining a pattern determiner according to an embodiment of the present disclosure.
Figure 19:
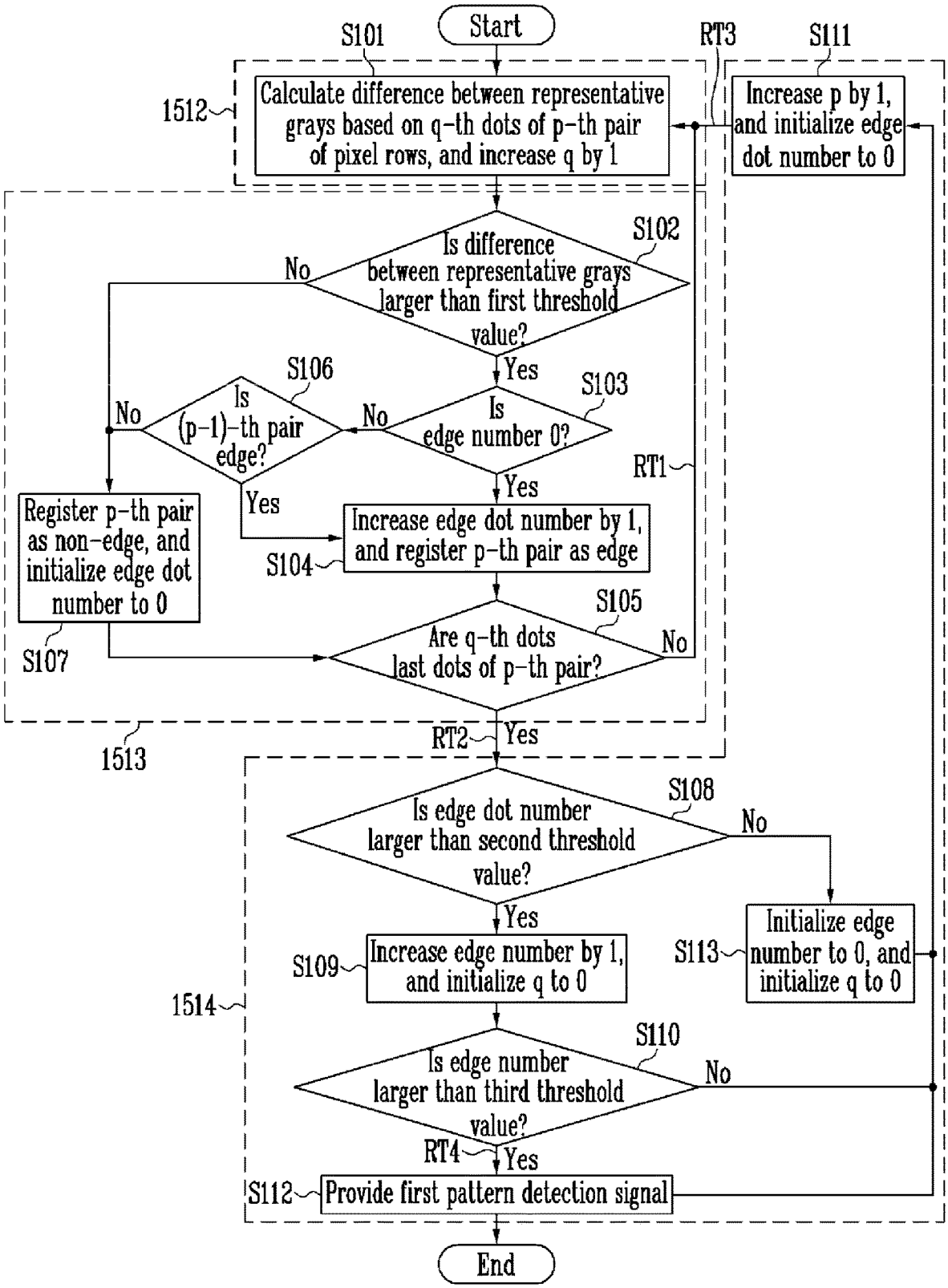
Figure 20:
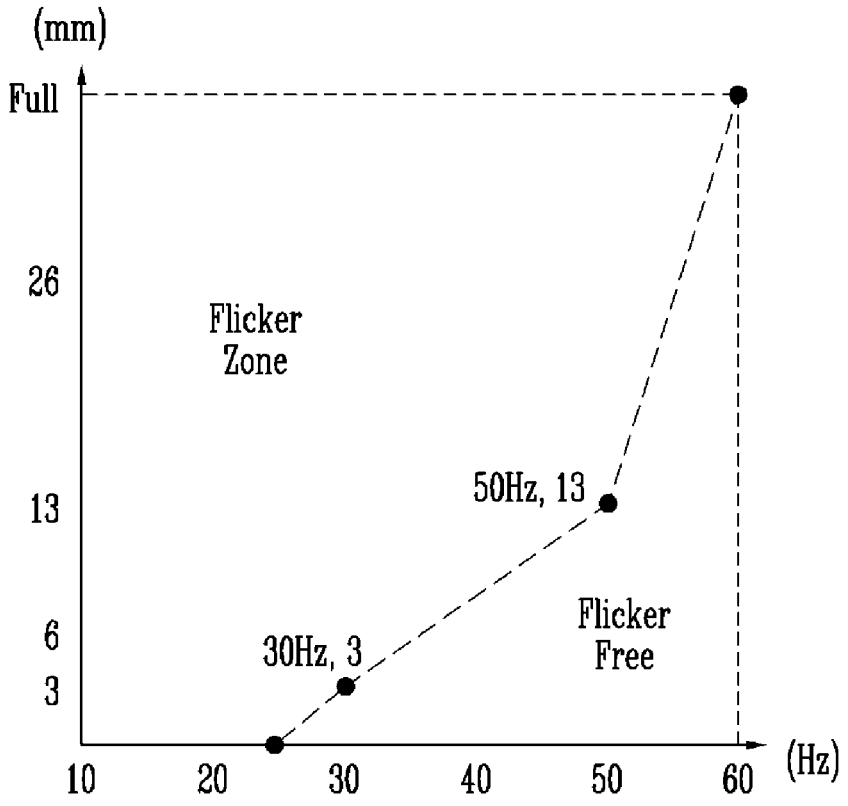

FIGS. 18, 19, and 20 illustrate schematic views for explaining a pattern determiner according to an embodiment of the present disclosure.

Referring to FIG. 18, the pattern determiner 151 according to an embodiment of the present disclosure may include a representative gray calculator 1511, a gray difference calculator 1512, an edge detector 1513, and a first pattern detector 1514.

When the display device 10 adopts the embodiment of FIG. 18, the pattern detection signal HSF of FIG. 17 may be the same as a first pattern detection signal HSF1.

The representative gray calculator 1511 may calculate representative grays RGY of dots based on the grays IGY of the input image. Respective grays IGY correspond to respective pixels, and representative grays may correspond to respective dots. Accordingly, when a ratio of the pixels to the dots is 3:1, a ratio of the grays IGY to the representative grays RGY in one input image may also be 3:1.

In one embodiment, the representative gray calculator 1511 may generate the representative grays RGY by transforming the grays IGY into a color space in a dot unit. Accordingly, a component that is most easily viewed by a user may be set as a representative gray.

For example, the representative gray calculator 1511 may convert R, G, and B grays of one dot into a YCoCg color space to obtain a Y value, and may determine the obtained Y value (luminance value) as the representative gray of the corresponding dot. As another example, the representative gray calculator 1511 may convert R, G, and B grays of one dot into an HSV color space to obtain an value, and may determine the obtained value as the representative gray of the corresponding dot.

In another embodiment, the representative gray calculator 1511 may calculate an average value of the grays IGY in a dot unit, so that it may determines the average value as the representative gray of each dot. Meanwhile, the representative gray calculator 1511 may further apply a weight value for each color in calculating the average value.

The gray difference calculator 1512 may calculate a difference DGY between representative grays RGY of adjacent dots in the second direction DR2 among dots of a p-th pair of the pixel rows. For example, the difference DGY of the representative grays RGY of a predetermined number of dots may be calculated based on q-th dots in the first direction DR1 among the dots of the p-th pair. In this case, p and q may be integers larger than 0. The predetermined number of dots may mean dots within a mask range using the q-th dots as a reference.

The edge detector 1513 may increase an edge dot number when a first condition that the difference DGY between the representative grays RGY is larger than a first threshold value is satisfied.

In the edge detector 1513, when the increased q-th dots are not the last dots of the p-th pair, according to a first route RT1, the edge detector 1513 may instruct so that according to a first route RT1, the gray difference calculator 1512 calculate the difference DGY of the representative grays RGY of dots of a predetermined number based on the q-th dots increased in the first direction DR1 among the dots of the p-th pair.

In addition, when the increased q-th dots are the last dots of the p-th pair, the edge detector 1513 may instruct so that the first pattern detector 1514 operates according to a second root RT2.

The first pattern detector 1514 may increase the edge number when the edge dot number is larger than a second threshold value, and it may generate a first pattern detection signal HSF1 when the edge number is larger than a third threshold value (fourth root RT4).

Meanwhile, when the edge dot number is smaller than the second threshold value or when the edge number is smaller than the third threshold value, the first pattern detector 1514 may instruct so that according to the third route RT4, the gray difference calculator 1512 calculates the difference DGY between the representative grays RGY of the dots adjacent in the second direction DR2 among the dots of a (p+1)-th pair of pixel rows.

Hereinafter, an operation of the pattern determiner 151 will be exemplarily described with reference to FIG. 16 and FIG. 19.

The gray difference calculator 1512 may calculate the difference between the representative grays based on the q-th dots of the p-th pair of pixel rows, and may increase q by 1 (S101). For example, it is assumed that p is 1 and q is 2. Assuming that the mask is 2 rows and 3 columns, the dots (DT11, DT12, DT13, DT21, DT22, and DT23) may be calculated based on the second dots DT12 and DT22 of the first pair PRP1. For example, the gray difference calculator 1512 may calculate the first difference value of the target grays of the dots DT11 and DT21, the second difference value of the target grays of the dots DT12 and DT22, and the third difference value of the target grays of the dots DT13 and DT23, and it may calculate an average value of the first to third difference values. This average value may be the difference between the representative grays. In this case, q increases to be 3.

In the case in which the algorithm of FIG. 19 is performed only with the difference between the target grays of the dots DT12 and DT22, which are reference dots, without a mask, when a fine portion of the pattern is cut off (that is, it is not a perfect pattern), it may be determined that there is no pattern. Therefore, a mask is required, but a size of the mask may be determined empirically in consideration of computational complexity and effectiveness.

In addition to the first condition (S102) that the difference between the representative grays is larger than the first threshold value, when the second condition that the edge number is 0 or the (p−1)-th pair is an edge is satisfied (S103 and S106), the edge detector 1513 may increase the edge dot number and register the p-th pair as an edge (S104). For example, it is assumed that the above-described average value is larger than the first threshold value, the initial value of the edge number is 0, and the initial value of the edge dot number is 0. At the time point in determining the first pair PRP1, since the edge number has not yet been increased, the edge number is zero. Therefore, by increasing the edge dot number by 1, the edge dot number becomes 1. In addition, the first pair PRP1 is registered as an edge. The first threshold value may be a minimum contrast value for luminance for allowing the odd numbered pixel row and the even numbered pixel row to configure the edge of the pattern. The first threshold value may be determined according to the specification of the display device 10, or may be determined by experience.

Meanwhile, when at least one of the first condition (S102) and the second condition (S103 and S106) is not satisfied, the edge detector 1513 may register the p-th pair as a non-edge, and may initialize the edge dot number (S107). That is, in this case, the dots determined up to at least current time point are not considered as constituent elements of the pattern.

After the p-th pair is registered as an edge or non-edge, when the increased q-th dots are not the last dots of the p-th pair (S105), the gray difference calculator 1512 may calculate a difference between representative grays of a predetermined number of dots based on the increased q-th dots (S101). For example, the first pair PRP1 is registered as an edge, but the third dots DT13 and DT23 are not the last dots of the first pair PRP1, so step S101 may be again performed by using the third dots DT13 and DT23 as reference dots.

Meanwhile, after the p-th pair is registered as an edge or non-edge, the first pattern detector 1514 may operate only when the increased q-th dots are the last dots of the p-th pair (RT2). Hereinafter, it is assumed that the sequentially increased q indicates the last dots of the first pair PRP1, and the first pattern detector 1514 operates.

When the edge dot number is smaller than the second threshold value (S113), the first pattern detector 1514 may initialize the edge number (S108). In this case, the first pattern detector 1514 may initialize q to 0. For example, that the edge dot number of the first pair PRP1 is smaller than the second threshold value may mean that the edge dots configuring the edge of the first pair PRP1 are insufficient. That is, the first pair PRP1 may mean that one stripe of the horizontal stripe pattern may not be configured. The second threshold value may define the size of the first direction DR1 of the pattern. The second threshold value may be an integer larger than 1.

Meanwhile, when the edge dot number is larger than the second threshold value, the first pattern detector 1514 may increase the edge number (S108 and S109). In this case, the first pattern detector 1514 may initialize q to 0. For example, that the edge dot number of the first pair PRP1 is larger than the second threshold value may mean that the edge dots configuring the edge of the first pair PRP1 are sufficient. That is, the first pair PRP1 may mean that one stripe (equal to edge) of the horizontal stripe pattern may be configured.

Next, the first pattern detector 1514 may determine whether the edge number is larger than the third threshold value (S110). Even if the first pair PRP1 configures one edge, since the edge number is still 1, the edge number may be smaller than the third threshold value. The third threshold value may define the size of the second direction DR2 of the pattern. For example, the third threshold value may be an integer larger than 1.

When the edge dot number is smaller than the second threshold value (S108) or when the edge number is smaller than the third threshold value (S110), the gray difference calculator 1512 may calculate a difference between representative grays of dots adjacent in the second direction DR2 among the dots of the (p+1)-th pair of the pixel rows (S111 and S101). In this case, the edge dot number may be initialized to 0 (S111). For example, the gray difference calculator 1512 may again perform step S101 for the second pair PRP2.

Meanwhile, when the edge number is larger than the third threshold value (S110), the first pattern detector 1514 may generate the first pattern detection signal (S112). That is, when a pattern having a size larger than the second threshold value in the first direction DR1 and larger than the third threshold value in the second direction DR2 exists, the first pattern detector 1514 may provide the first pattern detection signal.

Referring to FIG. 20, a graph in which a horizontal axis represents display frequencies (Hz) of input images, and a vertical axis represents sizes (for example, vertical or horizontal lengths in a case of a square) of the pattern is shown.

Referring to the graph of FIG. 20, the higher the display frequency and the smaller the pattern size, the lower the possibility of flicker occurs when the display device 10 is driven in the second display mode (Flicker Free). Meanwhile, the lower the display frequency and the larger the pattern size, the higher the possibility of flicker occurring when the display device 10 is driven in the second display mode (Flicker Zone). However, FIG. 20 is an example graph, which is empirically illustrated, and other graphs may be derived according to the specifications of the display device 10.

Figure 21:
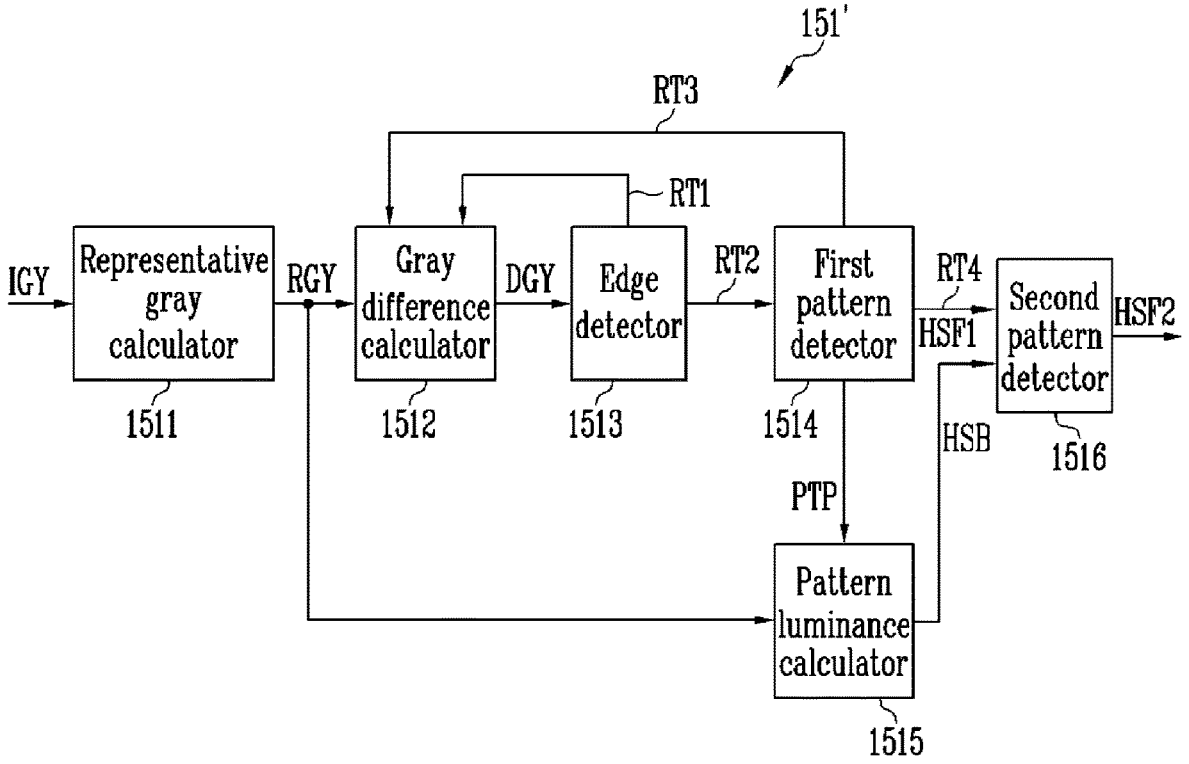
FIGS. 21 and 22 illustrate schematic views for explaining a pattern determiner according to another embodiment of the present disclosure.
Figure 22:
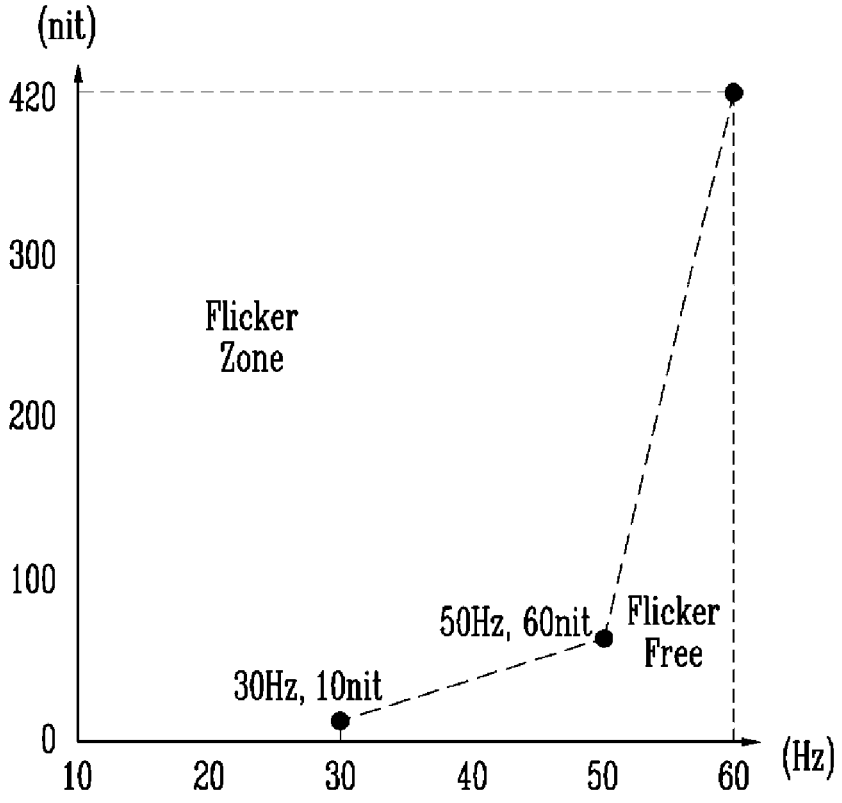

FIG. 21 and FIG. 22 illustrate schematic views for explaining a pattern determiner according to another embodiment of the present disclosure.

Referring to FIG. 21, a pattern determiner 151' according to an embodiment of the present disclosure may include a representative gray calculator 1511, a gray difference calculator 1512, an edge detector 1513, a first pattern detector 1514, a pattern luminance calculator 1515, and a second pattern detector 1516. The representative gray calculator 1511, the gray difference calculator 1512, the edge detector 1513, and the first pattern detector 1514 are the same as those described with reference to FIGS. 18, 19, and 20, so duplicate descriptions will be omitted.

When the display device 10 adopts the embodiment of FIG. 21, the pattern detection signal HSF of FIG. 17 may be the same as a second pattern detection signal HSF2.

When the first pattern detection signal HSF1 is generated, the first pattern detector 1514 may further generate pattern position information PTP for the detected pattern. For example, the pattern position information PTP may be information indicating dots configuring a pattern.

The pattern luminance calculator 1515 may calculate luminance of the pattern based on the pattern position information PTP and the representative grays RGY For example, the pattern luminance calculator 1515 may calculate an average value of the representative grays RGY of the dots indicated by the pattern position information PTP, and may determine the average value as the luminance of the pattern. In one embodiment, weight values according to the positions of the dots may be applied in the calculation of the average value.

The pattern luminance calculator 1515 may generate a pattern valid signal HSB when the luminance of the pattern is larger than the reference luminance. The pattern valid signal HSB may indicate that the luminance of the detected pattern is high enough to be able to be viewed by a user.

The second pattern detector 1516 may generate the second pattern detection signal HSF2 only when it receives both the pattern valid signal HSB and the first pattern detection signal HSF1.

That is, according to the present embodiment, whether to enter the second display mode is determined by considering not only the size of the pattern but also the luminance of the pattern. Therefore, even if the size of the pattern is sufficiently large, when the luminance of the pattern is low and the possibility of being viewed by the user is low, the display device 10 may be driven in the second display mode to reduce power consumption.

Unlike FIG. 21, in another embodiment, the pattern luminance calculator 1515 may generate the pattern valid signal HSB when the difference DGY between the representative grays RGY is larger than or equal to a specific value. In this case, the pattern luminance calculator 1515 may not directly receive the representative grays RGY In one embodiment, the pattern luminance calculator 1515 may not directly receive the pattern position information PTP.

Referring to FIG. 22, a graph in which a horizontal axis represents display frequencies (Hz) of input images, and a vertical axis represents luminance (nit) of the pattern is shown.

Referring to the graph of FIG. 22, the higher the display frequency and the smaller the pattern luminance, the lower the possibility of flicker occurs when the display device 10 is driven in the second display mode (Flicker Free). Meanwhile, the lower the display frequency and the larger the pattern luminance, the higher the possibility of flicker occurring when the display device 10 is driven in the second display mode (Flicker Zone). However, FIG. 22 is an example graph, which is empirically illustrated, and other graphs may be derived according to the specifications of the display device 10.

While this disclosure has been described in connection with what is presently considered to be practical embodiments, it is to be understood that the disclosure is not limited to the disclosed embodiments, but, on the contrary, is intended to cover various modifications and equivalent arrangements included within the spirit and scope of the appended claims. Therefore, those skilled in the art will understand that various modifications and other equivalent embodiments of the present disclosure are possible. Consequently, the true technical protective scope of the present disclosure must be determined based on the technical spirit of the appended claims.

What is claimed is:

1. A display device comprising:

a pixel unit in which each of pixel rows extends in a first direction, odd numbered pixel rows and even numbered pixel rows are alternately disposed in a second direction, and pixels included in the pixel rows are designated as dots having two or more units;

a gray difference calculator configured to calculate difference between representative grays of dots adjacent in the second direction among p-th pair dots of the pixel rows;

an edge detector that increases an edge dot number when a first condition in which the difference between the representative grays is larger than a first threshold value is satisfied; and a first pattern detector that increases an edge number when the edge dot number is larger than a second threshold value, and that generates a first pattern detection signal when the edge number is larger than a third threshold value.

2. The display device of claim 1, further comprising:

a scan driver that, when the first pattern detection signal is not generated, and when an image is determined to be a still image, provides scan signals having a turn-on level to the odd-numbered pixel rows during a first sub-frame period, and provides scan signals having a turn-on level to the even-numbered pixel rows during a second sub-frame period after the first sub-frame period.

3. The display device of claim 2, wherein, when the first pattern detection signal is generated and when the image is determined to be the still image, the scan driver alternately provides the scan signals having the turn-on level to between the odd numbered pixel rows and the even numbered pixel rows.

4. The display device of claim 1, wherein the gray difference calculator calculates difference between the representative grays of a predetermined number of dots including q-th dots in the first direction among the p-th pair dots, and increases q.

5. The display device of claim 4, wherein when a second condition that the edge number is 0, or a (p−1)-th pair is an edge is satisfied in addition to the first condition, the edge detector increases the edge dot number and registers the p-th pair as the edge.

6. The display device of claim 5, wherein, when at least one of the first condition and the second condition is not satisfied, the edge detector registers the p-th pair as a non-edge, and initializes the edge dot number.

7. The display device of claim 6, wherein after the p-th pair is registered as the edge or the non-edge, when increased q-th dots are not last dots of the p-th pair, the gray difference calculator calculates difference between representative grays of a predetermined number of dots including the increased q-th dots.

8. The display device of claim 7, wherein the first pattern detector operates only when the increased q-th dots are the last dots of the p-th pair after the p-th pair is registered as the edge or the non-edge.

9. The display device of claim 8, wherein, when the edge dot number is smaller than the second threshold value, the first pattern detector initializes the edge number.

10. The display device of claim 9, wherein, when the edge dot number is smaller the second threshold value, or the edge number is smaller than the third threshold value, the gray difference calculator calculates difference between representative grays of dots adjacent to the second direction among dots of a (p+1)-th pair of the pixel rows.

11. The display device of claim 1, wherein the first pattern detector, when the first pattern detection signal is generated, further generates pattern position information for a detected pattern, and wherein the display device further includes a pattern luminance calculator configured to calculate luminance of the pattern based on the pattern position information and the representative grays.

12. The display device of claim 11, wherein the pattern luminance calculator generates a pattern valid signal when the luminance of the pattern is larger than a reference luminance, and wherein the display device further includes a second pattern detector configured to generate a second pattern detection signal only when both the pattern valid signal and the first pattern detection signal are received.

13. The display device of claim 12, further comprising:

a scan driver that, when the second pattern detection signal is not generated, and when an image is determined to be a still image, provides scan signals having a turn-on level to the odd-numbered pixel rows during the first sub-frame period, and provides scan signals having a turn-on level to the even-numbered pixel rows during the second sub-frame period after the first sub-frame period.

14. The display device of claim 13, wherein, when the second pattern detection signal is generated, and when the image is determined to be the still image, the scan driver alternately provides the scan signals having the turn-on level to between the odd numbered pixel rows and the even numbered pixel rows.

15. A driving method of a display device that includes a pixel unit in which respective pixel rows extend in a first direction, odd numbered pixel rows and even numbered pixel rows are alternately disposed in a second direction, and pixels included in the respective pixel rows are designated as dots having two or more units, comprising:

calculating difference between representative grays of dots adjacent in the second direction among dots of a p-th pair of the pixel rows;

increasing an edge dot number when a first condition that the difference between the representative grays is larger than the first threshold value is satisfied;

increasing an edge number when the edge dot number is larger than a second threshold value; and generating a first pattern detection signal when the edge number is larger than a third threshold value.

16. The driving method of the display device of claim 15, further comprising:

providing, when the first pattern detection signal is not generated, and when an image is determined to be a still image, scan signals having a turn-on level to the odd-numbered pixel rows during a first sub-frame period, and providing scan signals having a turn-on level to the even-numbered pixel rows during a second sub-frame period after the first sub-frame period.

17. The driving method of the display device of claim 16, further comprising:

alternately providing, when the first pattern detection signal is generated, and when the image is determined to be the still image, the scan signals having the turn-on level to between the odd numbered pixel rows and the even numbered pixel rows.

18. The driving method of the display device of claim 15, further comprising:

generating, when the first pattern detection signal is generated, pattern position information for a detected pattern;

calculating luminance of the pattern based on the pattern position information and the representative grays;

generating a pattern valid signal when the luminance of the pattern is larger than a reference luminance; and generating a second pattern detection signal only when both the pattern valid signal and the first pattern detection signal are received.

19. The driving method of the display device of claim 18, further comprising:

providing, when the second pattern detection signal is not generated, and when an image is determined to be a still image, scan signals having a turn-on level to the odd-numbered pixel rows during the first sub-frame period, and providing scan signals having a turn-on level to the even-numbered pixel rows during the second sub-frame period after the first sub-frame period.

20. The driving method of the display device of claim 19, further comprising:

alternately providing, when the second pattern detection signal is generated, and when the image is determined to be the still image, the scan signals having the turn-on level to between the odd numbered pixel rows and the even numbered pixel rows.

* * * * *